United States Patent [19]

Thorne

[11] 4,167,215

[45] Sep. 11, 1979

[54] GUIDELINELESS SUBSEA WELLHEAD ENTRY/REENTRY SYSTEM

[75] Inventor: Paul M. Thorne, Escondito, Calif.

[73] Assignee: FMC Corporation, San Jose, Calif.

[21] Appl. No.: 856,879

[22] Filed: Dec. 2, 1977

[30] Foreign Application Priority Data

Feb. 26, 1977 [GB] United Kingdom ..... 8215/77

[51] Int. Cl.[2] ..... E21B 7/12

[52] U.S. Cl. ..... 166/341; 175/7; 166/337

[58] Field of Search ..... 175/5, 7; 166/0.5, 0.6; 294/66 R, 66 A; 61/69

[56] References Cited

U.S. PATENT DOCUMENTS

| | | | |
|---|---|---|---|
| 3,177,954 | 4/1965 | Rand | 166/0.6 X |
| 3,179,176 | 4/1965 | Goepfert | 166/0.6 |
| 3,189,105 | 6/1965 | Bates et al. | 175/5 |
| 3,199,613 | 8/1965 | Malott et al. | 175/5 |
| 3,500,906 | 3/1970 | Petersen | 175/7 X |
| 3,545,539 | 12/1970 | Manning | 166/0.5 |
| 3,741,296 | 6/1973 | Murman et al. | 166/0.6 |
| 3,788,396 | 1/1974 | Shatto et al. | 166/0.5 |
| 4,031,544 | 6/1977 | Lapetina | 175/5 X |

*Primary Examiner*—Ernest R. Purser
*Assistant Examiner*—Richard E. Favreau
*Attorney, Agent, or Firm*—Lloyd B. Guernsey; W. William Ritt, Jr.

[57] ABSTRACT

A guidelineless subsea wellhead system includes TV/sonar guidance components which direct operating and/or service equipment into a position adjacent a subsea wellhead. An offset funnel mounted on the wellhead is used to guide a probe, which is mounted on a riser, into alignment with the wellhead. The probe is used to guide the riser and the service equipment into exact alignment with the wellhead so that tasks such as well entry, tree installation, well reentry, tree cap removal, tree cap replacement and downhole wireline operations can be completed without any cable guidelines. The system can also be used with the usual guidelines to increase the speed and accuracy of connecting to the wellhead.

22 Claims, 37 Drawing Figures

11
36a
51
51
50a
50b
15
44a
67
20
49b
34a
49a
49
36b
54
50a
50b
55
55
20a
58
20

FIG_3
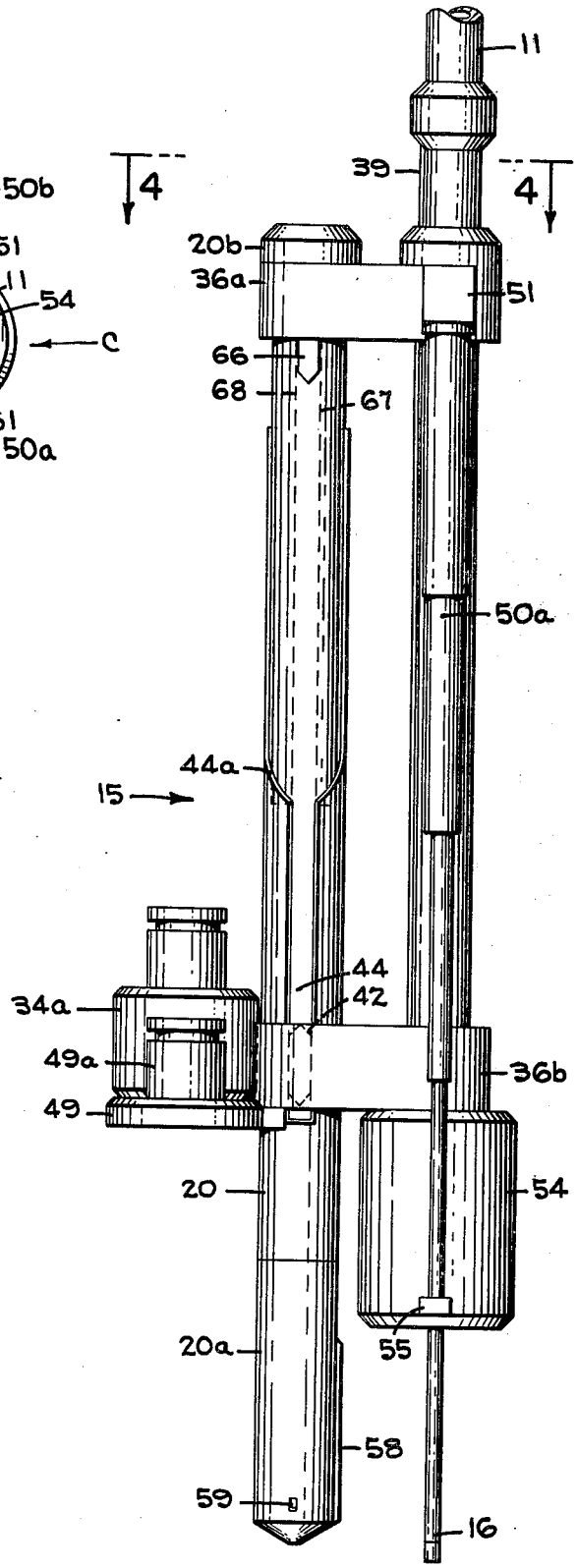
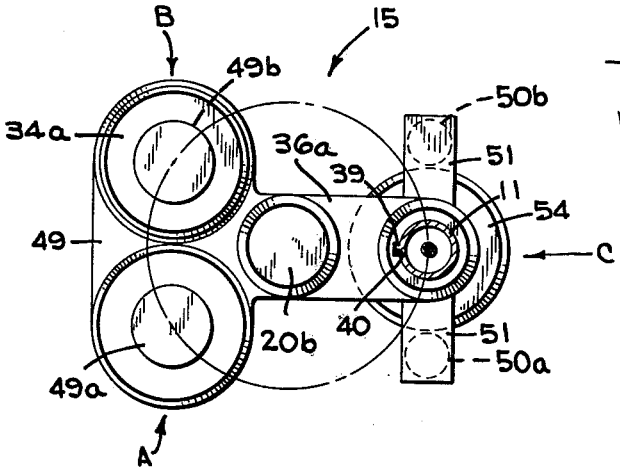
FIG_4

FIG_7
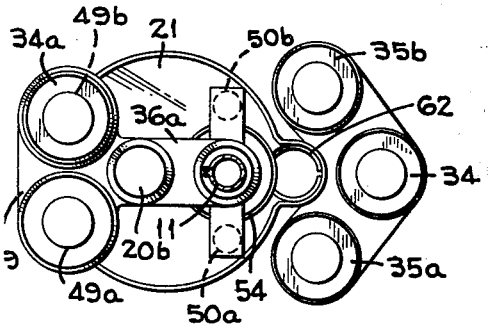
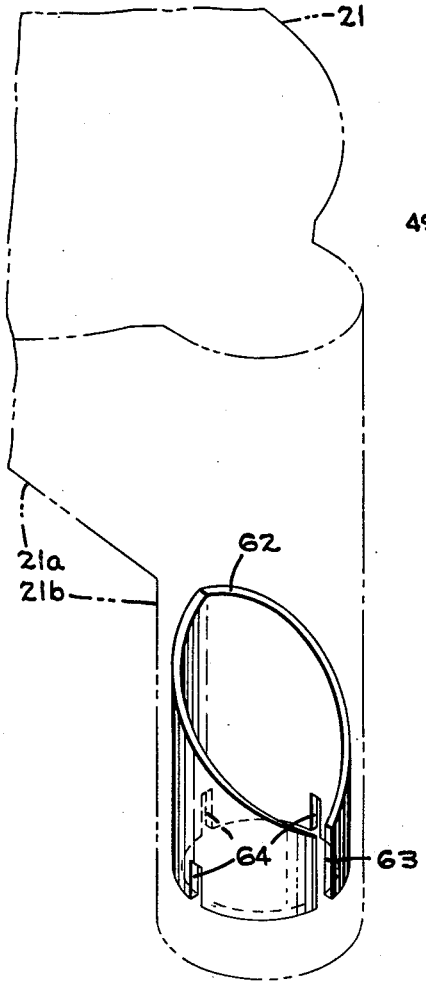
FIG_6
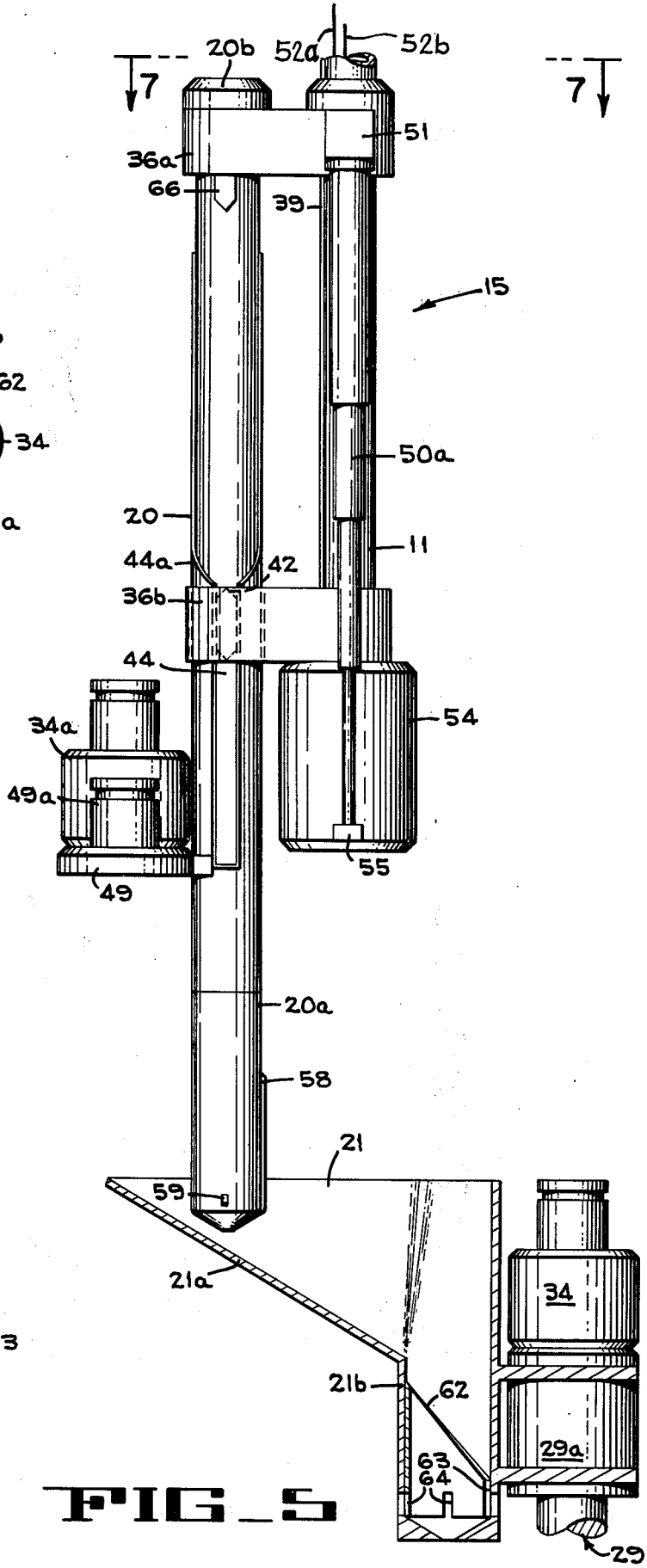
FIG_5

FIG_14
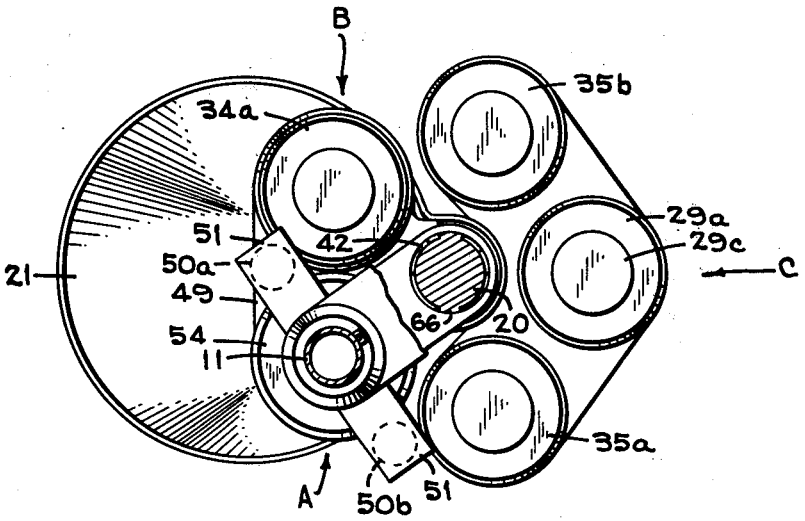
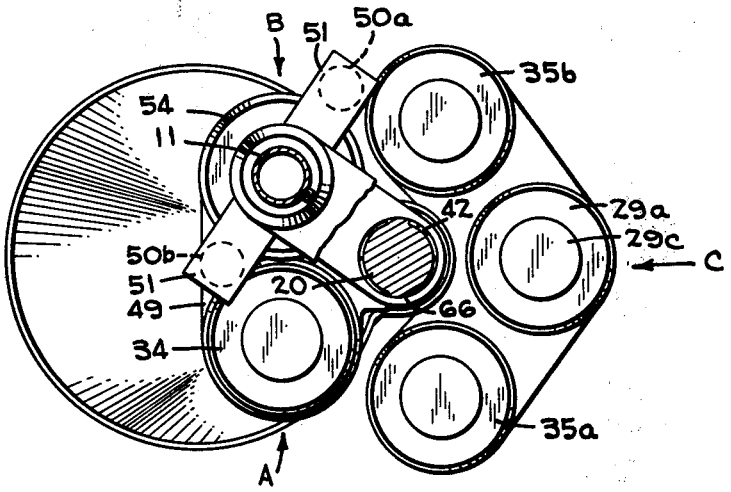
FIG_15

FIG_19
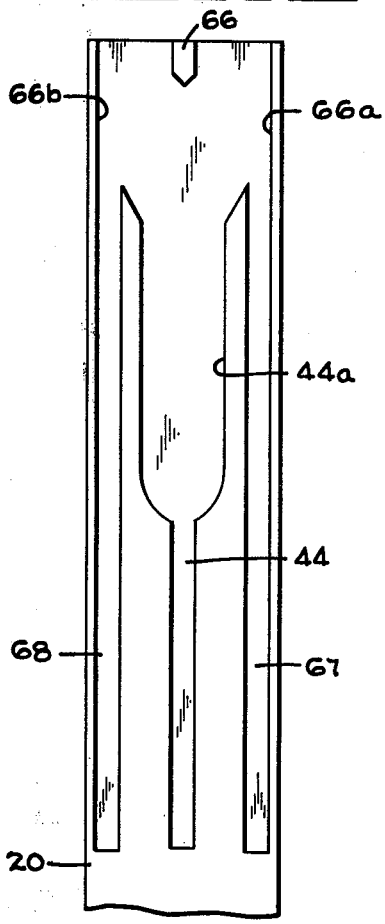
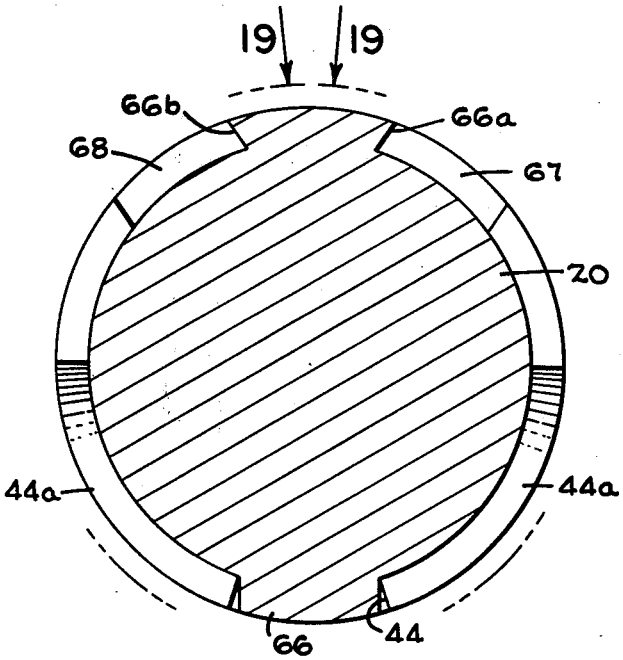
FIG_18

FIG_20
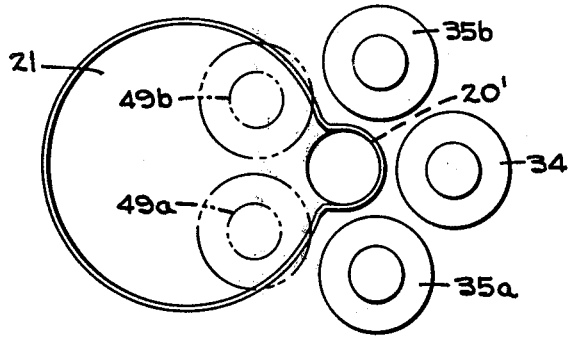
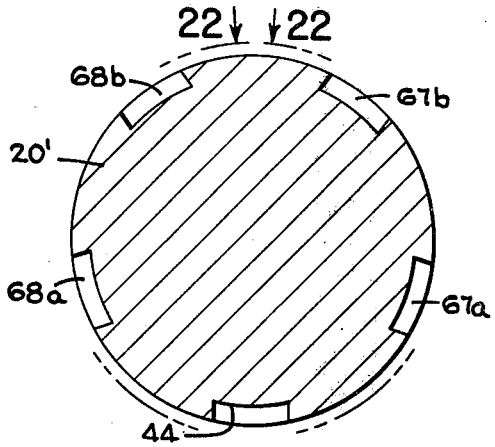
FIG_21
FIG_22
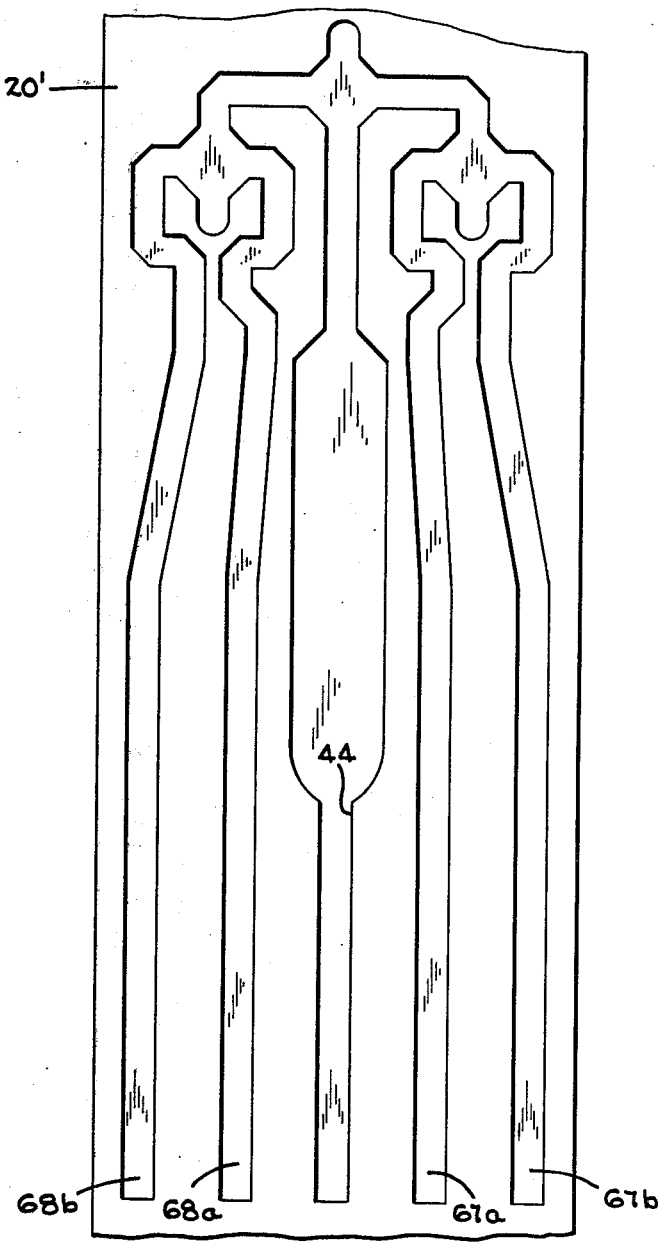

GUIDELINELESS SUBSEA WELLHEAD ENTRY/REENTRY SYSTEM

BACKGROUND OF THE INVENTION

1. Field of the Invention

This invention relates to subsea wellhead systems, and more particularly to a guidelineless system for entry or reentry into a subsea wellhead.

2. Description of the Prior Art

The production of oil and gas from offshore wells has developed into a major endeavor of the petroleum industry. Wells are commonly drilled several hundred or even several thousand feet below the surface of the ocean. These wells must not only be drilled without the use of divers at the deeper depths, but the connecting, testing and servicing of pipes and of regulating valves must be performed on these wells during and after the drilling process.

Some of the prior art wellhead facilities include a foundation causing which is connected to a wellhead guidebase and having a plurality of guideposts connected to the guidebase. A separate guide cable is connected between each of the guideposts and a surface vessel so that the subsea tree, blowout preventers, valves and service tools can be guided into position on the well by these guide cables. If these guide cables break or become entangled it is expensive to correct the problem and to lower the equipment to the wellhead. If the well should be temporarily abandoned it is necessary to remove the cables from the guideposts so that the cables can be retrieved. If it is desired to reenter the well at a later time it is necessary to send divers to the seafloor to connect new cables to the guideposts. In deeper water this is impossible to do; and even in shallower water this procedure is expensive.

Some of the prior art wellhead facilities include guidelinesless apparatus having TV/sonar guidance equipment which uses TV and sonar for visual guidance of working tools into position to remove the tree assembly from the seafloor and raise the tree assembly to a surface vessel for repair and service. This prior art equipment does not have the accuracy and dexterity of movement required for much of the repair work on the equipment at the seafloor. Therefore, the tree assembly must be removed and brought to the surface for some of the repair work, a procedure which is time consuming and expensive.

What is needed is apparatus which can be used to guide the service and repair equipment into precisely defined positions adjacent the wellhead so that service work and repairs can be done on the tree assembly, valves, etc. without the time and expense of bringing these elements to the surface vessel.

SUMMARY OF THE INVENTION

The present invention overcomes some of the disadvantages of the prior art by employing a wellhead locating means such as TV/sonar guidance equipment to locate the wellhead so that a riser can be positioned near the wellhead. A wellhead locating means, a locking probe and a component manipulator device are mounted on the riser. The wellhead locating means can be used to guide the locking probe and the component manipulator device into a position near the wellhead. An offset funnel having a wide mouth portion and a smaller neck portion is mounted on the wellhead to guide the probe and the manipulator device into exact alignment with the wellhead as the riser is moved closer to the wellhead. The mouth portion of the funnel has a sloping contour to facilitate the movement of the probe over the mouth portion toward the neck portion. The neck portion of the offset funnel has a means for securing the probe in position after the probe has been moved into the neck portion of the funnel. The manipulator device can then be used to perform repair and replacement work on the various portions of the wellhead.

BRIEF DESCRIPTION OF THE DRAWINGS

FIG. 3 is a side elevation of the reentry apparatus shown in FIG. 2.

FIG. 4 is a plan of the apparatus of FIG. 3, viewed in the direction of the arrows 4—4 of FIG. 3.

FIG. 5 is a side elevation of the reentry funnel and locking probe.

FIG. 6 is an enlarged isometric view of a portion of the funnel of FIG. 5.

FIG. 7 is a plan of the apparatus of FIG. 5, viewed in the direction of the arrows 7—7 of FIG. 5.

FIG. 14 is a plan of the apparatus of FIG. 12, viewed in the direction of the arrows 14—14 of FIG. 12.

FIG. 15 is a plan of the apparatus of FIG. 13, viewed in the direction of the arrows 15—15 of FIG. 13.

FIG. 18 is a horizontal section taken along line 18—18 of FIG. 10.

FIG. 19 is a developed view taken generally in the direction of arrows 19—19 of FIG. 18.

FIG. 20 is a plan view, similar to FIG. 14 but with a portion of the apparatus removed to show placement of other portions.

FIG. 21 is a horizontal section, similar to FIG. 18, of a second embodiment of the invention.

FIG. 22 is a developed view taken generally in the direction of arrows 22—22 of FIG. 21.

DESCRIPTION OF THE PREFERRED EMBODIMENT

Figure 1:
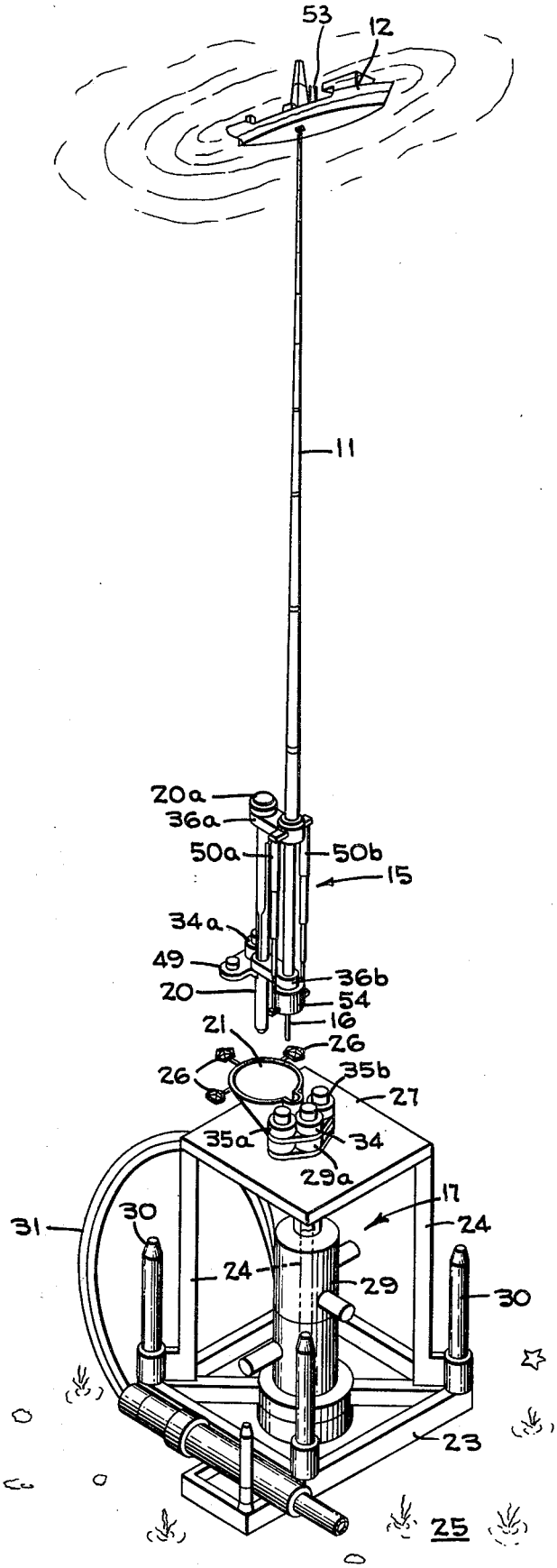
FIG. 1 is a perspective view of a guidelineless subsea wellhead system according to the present invention, illustrating the reentry apparatus.
Figure 2:
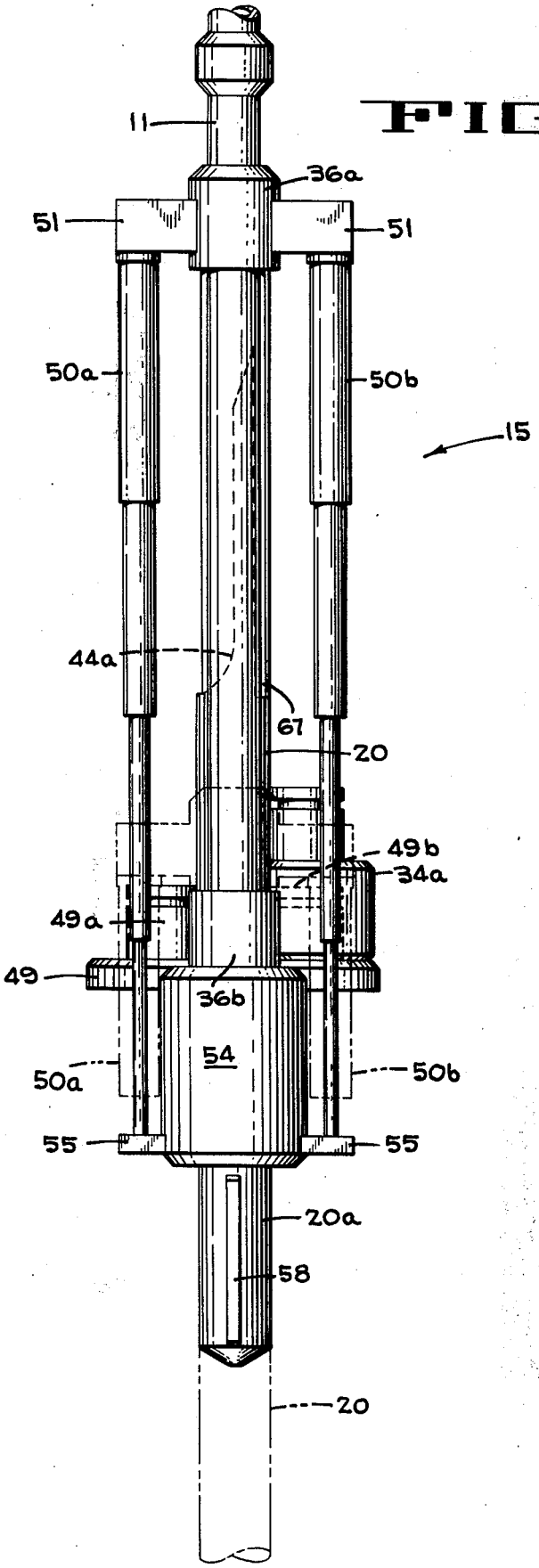
FIG. 2 is a front elevation of a portion of the guidelineless system of FIG. 1 showing details of the reentry apparatus.
Figure 9:
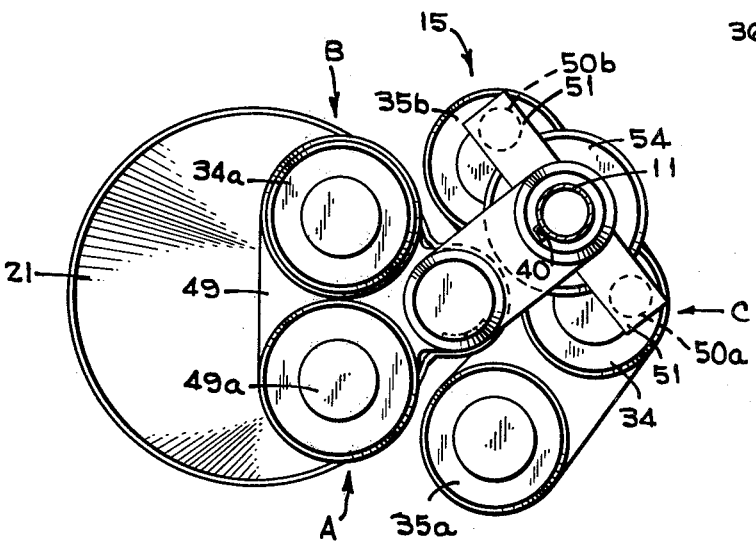
FIG. 9 is a plan of the apparatus of FIG. 8, viewed in the direction of the arrows 9—9 of FIG. 8.

A guidelineless subsea wellhead reentry system in accordance with the present invention comprises a completion riser 11 or other type of tubular column having the upper end thereof connected to a surface vessel 12 (FIG. 1) and the lower end thereof connected to a component manipulator device 15. Connected between the vessel 12 and the lower end of the manipulator device 15 is a TV/sonar tool 16 which is used to locate a subsea installation, such as a wellhead 17. The TV/sonar tool is encased in the riser 11 with the upper end thereof connected to standard TV/sonar sending-/receiving equipment (not shown) inside the vessel, and with the lower end of the tool 16 projecting below the end of the riser 11. The TV/sonar tool may be one of the types which is commercially available, such as the "High Resolution Reentry (HRR) System" manufactured by the Edo Western Corporation of Salt Lake City, Utah. Such a system includes a sonar transmitter which directs high frequency signals outward from the tool 16. These signals are reflected by reflectors, received by the tool 16, and directed to equipment aboard the surface vessel 12. Also connected to the lower end of the manipulator device 15 is a reentry probe 20 which is adapted to slide into operating position in an offset reentry funnel 21 located on the upper portion of the wellhead. The wellhead 17 includes a guidebase 23 that is connected to a foundation casing (not shown) which extends into the seafloor 25. Mounted on the guidebase 23 are a plurality of support posts 24, a subsea tree 29 and a plurality of guide posts 30. Mounted on the upper ends of the support posts 24 is a support plate 27 which supports the upper end of the subsea tree 29. Connected to the offset funnel 21 are a plurality of sonar reflectors 26. A plurality of flowlines 31 (only one of which is shown) may be connected to the subsea tree 29. A tree cap 34 and a pair of control pods 35*a*, 35*b* are mounted to the upper end of the subsea tree 29. During the installation of the guidebase 23 it may be desirable to connect guide cables (not shown) to the guideposts 30 to aid in installing the subsea tree 29.

The component manipulator device 15 (FIGS. 2–8) includes a pair of guide sleeves 36*a*, 36*b* connected between the riser 11 and the reentry probe 20. The left end of the upper guide sleeve 36*a* (FIG. 3) is free to pivot about the upper portion of the probe 20 while a riser guide spline 39, which is free to slide up and down in a groove 40 in the upper guide sleeve (FIG. 4), prevents the riser 11 from rotating relative to the right end of the guide sleeve 36*a*. An enlarged end portion 20*b* of the probe rests on the upper edge of the upper guide sleeve 36*a* to provide support for the probe 20. A replaceable tip 20*a* is connected to the lower end of the probe 20. The right end portion of the lower sleeve 36*b* is welded or otherwise fastened to the lower end of the riser to prevent the guide sleeve 36*b* from rotating relative to the riser 11. The left end portion of the lower guide sleeve 36*b* (FIG. 3) includes a bore having an inwardly projecting lug 42 which is free to slide up and down in a groove 44 in the probe 20.

A storage bracket 49 that is connected to the probe 20 includes a pair of storage depots 49*a*, 49*b* (FIG. 2) which are adapted to store tree caps or control pods. A spare tree cap 34*a* is shown in position on the storage depot 49*b* in FIGS. 3 and 4. The upper ends of a pair of hydraulic lowering rams 50*a*, 50*b* are connected to the upper guide sleeve 36*a* by a pair of ears 51 which are welded or otherwise connected to the sleeve 36*a*. The rams 50*a*, 50*b* may be powered in either an extending direction or in a Power to operate the lowering rams 50*a*, 50*b*, is provided by a pair of hydraulic lines 52*a*, 52*b* (FIG. 5) extending through the riser 11 between the lowering rams and a remote control 53 (FIG. 1) on the surface vessel 12. The lower end of each of the lowering rams 50*a*, 50*b* is connected to a running tool 54 by a pair of ears 55. The lowering rams are shown in the extended position in FIG. 3 and with the lug 42 near the bottom of the groove 44. When the lowering rams are moved into the collapsed position shown in FIG. 8 the upper and lower guide sleeves 36*a* and 36*b* are positioned adjacent each other. The running tool 54 is connected to the lower end of the riser 11. The lower end of the TV/sonar tool 16 is shown projecting below the running tool in FIG. 3, but is should be understood that the TV/sonar tool may be retracted into the riser 11 when the running tool 54 is in use.

The tip 20*a* of the reentry probe 20 (FIG. 5) includes a guide key 58 and a plurality of probe latches 59. The reentry funnel (FIGS. 5 and 6) includes an inwardly extending orienting cam 62 having a slot 63 and a plurality of funnel locking detents 64 near the bottom portion of the funnel. The funnel 21 is welded or otherwise connected to the upper portion 29*a* of the subsea tree 29 (FIG. 1). When the probe 20 is lowered into the funnel (FIG. 5) the tip 20*a* slides down the inclined portion 21*a* into the neck portion 21*b* where the key 58 of the probe makes contact with the orienting cam 62. As the probe is lowered further into the next portion of the funnel, the key 58 slides down the orienting cam 62 causing the probe 20 to rotate into the position shown in FIG. 8 with the key 58 inside the slot 63 (FIG. 6), and the probe latches 59 projecting into the detents 64. The probe latches 59 and the detents 64 prevent the probe 20 from moving out of the funnel and allow the surface vessel to apply an upward tension on the riser to prevent it from buckling. The key 58 and the slot 63 orient the running tool 54 relative to the tree cap 34 and the control pods 35.

Figure 12:
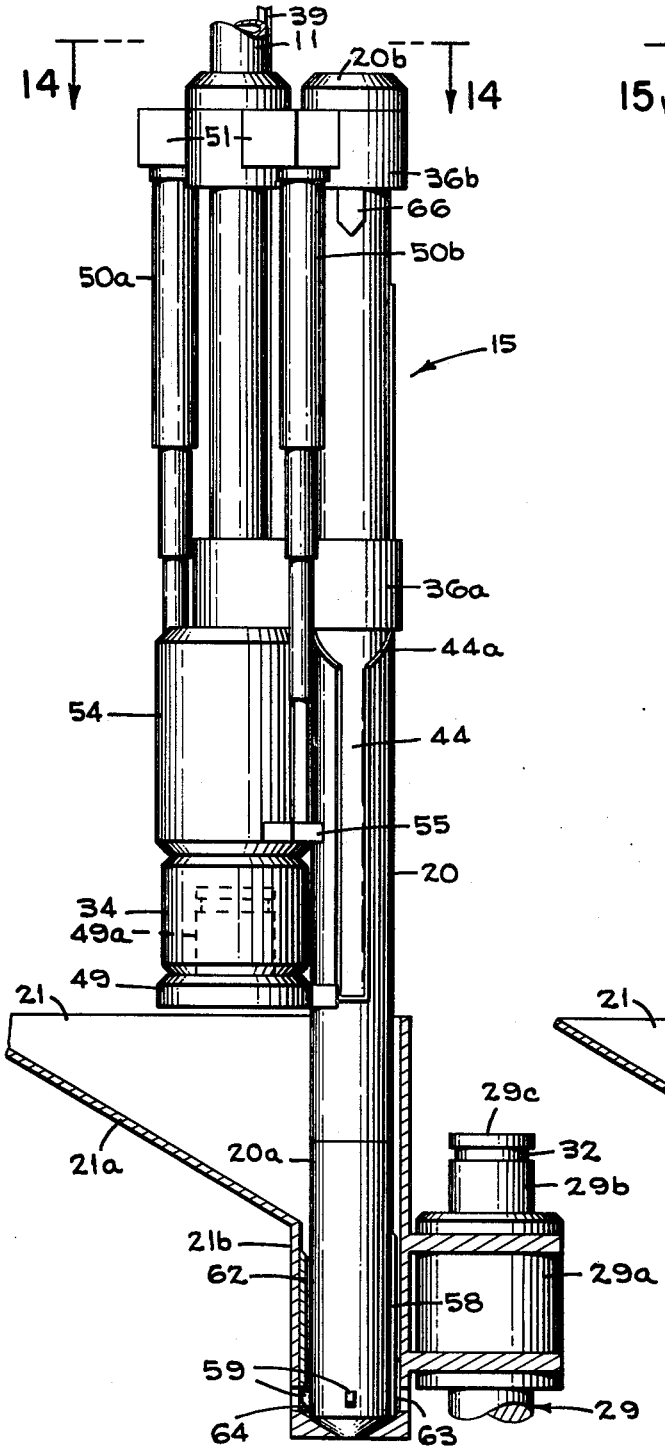
Figure 13:
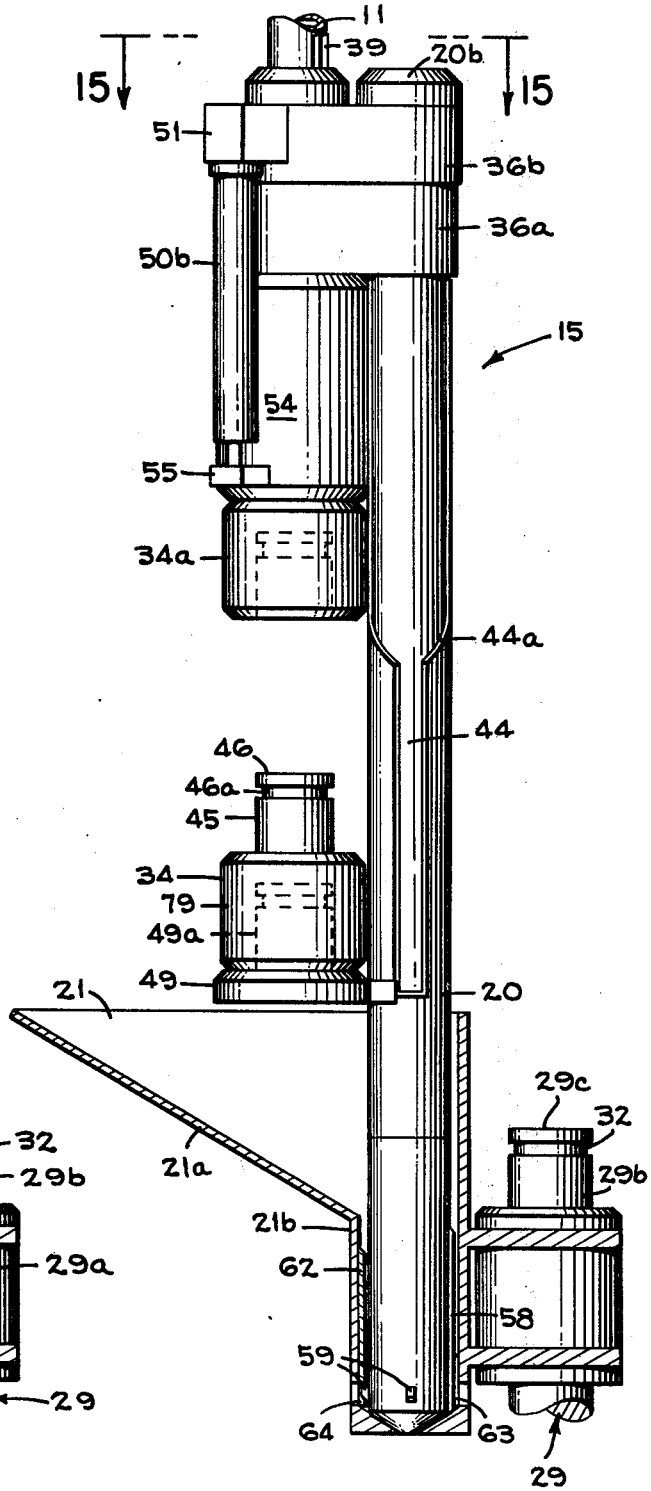
Figure 17:
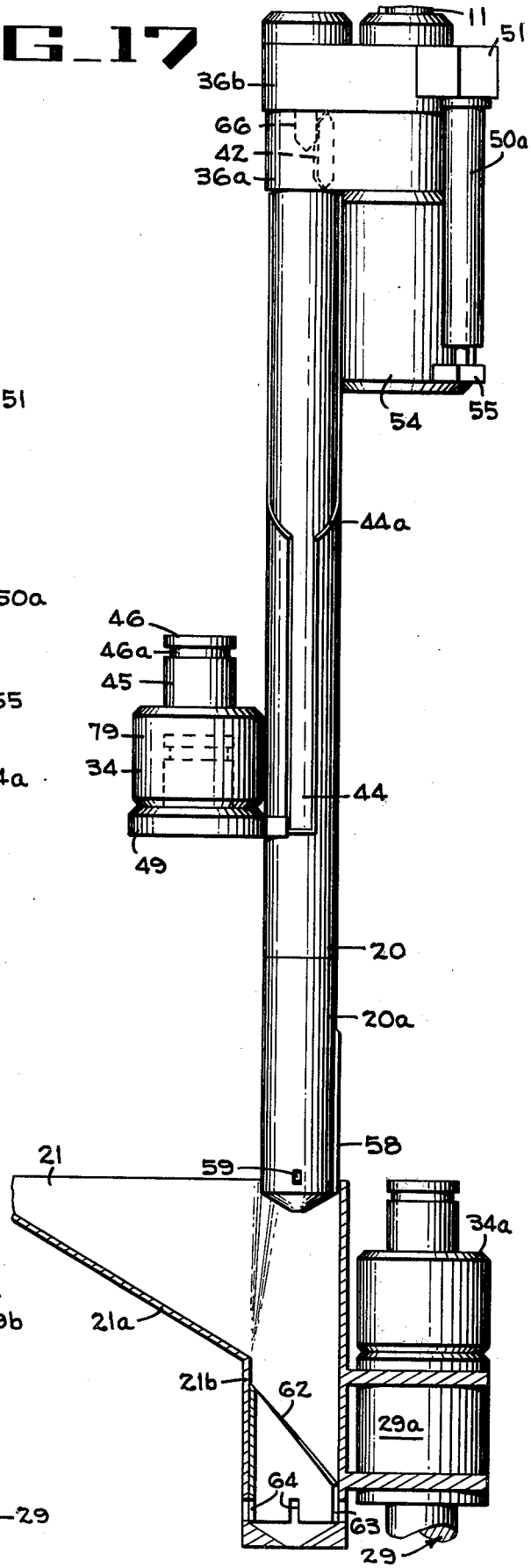
FIGS. 16 and 17 are side elevations, similar to FIGS. 10–13, showing a further sequence of operation of the apparatus.

The reentry probe 20 includes a plurality of grooves 44, 67 and 68 (FIGS. 3, 19) that cooperate with the inwardly projecting lug 42 to position the running tool 54 above one of the work or storage positions A, B, C shown in FIG. 4. When the lug 42 is positioned in the lower portion of the groove 44, the riser 11 is in the "C position" as shown in FIGS. 3 and 4. As the probe 20 is moved downward, so that the lug 42 moves into a wider portion 44*a* of the center groove, the riser 11 is free to pivot about the probe 20 into a position a few degrees either side of the C position. This movement can best be seen by referring to FIGS. 17–19. The FIG. 19 discloses a "developed view" of the probe 20 where the curved surface of the cylindrical probe is drawn as a flat surface having the groove 44 in the center. The lower portion of the center groove 44 is substantially the same width as the lug 42 thereby preventing lateral movement of the lug in the lower portion of the groove 44. When the lug 42 moves into the wider portion 44*a* some lateral movement of the lug is possible. As the lug 42 moves upward to a position near a rotational stop 66, the lug 40 may move to the right (FIG. 19) into the groove 67 or the left into the groove 68, thereby allowing the riser 11 to move into a "B position", shown in FIGS. 13 and 15, or into an "A position", shown in FIGS. 12 and 14.

After the probe 20 is locked into place in the funnel 21, the lug 42 may be biased to the right portion of the groove 44*a* by rotating the upper end of the riser 11 (FIGS. 1, 11, 19) a few degrees in a counterclockwise direction as seen from the top of the riser. When the lug 42 reaches the top end of the groove 44 (FIG. 19) the lug then moves to the right against a right wall 66*a* so that the riser 11 and the running tool 54 are directly above the B position as shown in FIG. 15. The lug can then be lowered into the groove 67 to enable the running tool 54 to pick up or to deposit a subsea tree component on the storage position B.

The lug 42 can then be raised to the top of the groove 67 (FIG. 19) by collapsing the hydraulic rams 50*a*, 50*b*, and the riser 11 can be rotated a few degrees clockwise to move the lug into a position against the right side of the rotational stop 66. When the hydraulic rams 50*a*, 50*b* are extended, the lug 42 moves down into the groove 44*a*. To move the lug into the groove 68 the riser 11 is biased a few more degrees clockwise and the hydraulic rams 50*a*, 50*b* are collapsed so that the lug 42 rides up the left side of the groove 44*a* and moves against a left wall 66*b*. The hydraulic rams 50*a*, 50*b* are then extended so that the lug 42 moves down into the groove 68 and the running tool 54 moves over the storage position A (FIG. 14). The position of the lug 42 in the grooves 44, 67 and 68, and the position of the running tool 54 relative to the positions A, B and C (FIG. 4), can be ascertained by knowing the rotational direction in which the riser 11 is biased while the hydraulic rams 50*a*, 50*b* are being collapsed or extended. The position of the running tool 54 can be doublechecked by extending the TV/sonar tool 16 (FIG. 3) from the lower end of the running tool and observing the wellhead area.

Figure 23:
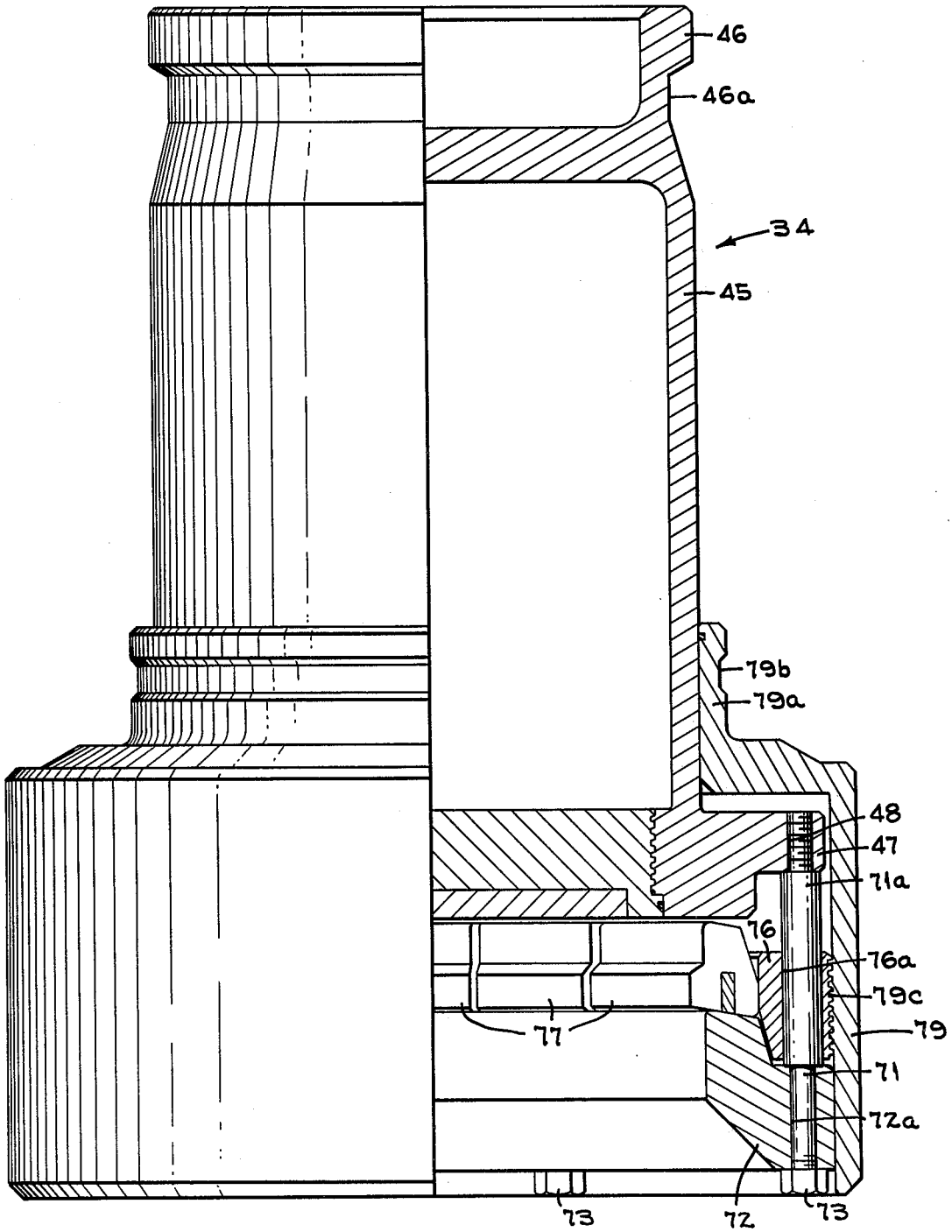
FIG. 23 is an enlarged side elevation with portions being broken away, of a tree cap for a wellhead.

The tree cap 34 includes a generally cylindrical housing 45 (FIG. 23) having an annular top flange 46 at the upper end thereof and an annular lower flange 47 at the bottom end thereof. Spaced about the lower flange 47 is a plurality of threaded bores 48, only one of which is shown, extending vertically through the flange. Spaced about the lower end of the housing 45 is a plurality of guides 71, only one of which is shown in FIG. 23, each guide having a threaded upper end, an enlarged cam surface 71*a*, and a cylindrically shaped lower portion having a threaded lower end portion. The upper end of each of the guides 71 is threaded into a corresponding one of the bores 48. An annular ring 72 is connected to the housing 45 by the guides 71. The lower portion of each of the guides extends through a bore 72*a* in the ring 72 and a nut 73 is threaded on to the lower end of the guide. An annular actuator ring 76 having a plurality of bores 76*a* therein is mounted above the ring 72 with each of the guides 71 extending through one of the bores in the actuator ring 76 so that the actuator ring 76 may move up and down about the guides 72. A plurality of locking dogs 77 are constructed of a split ring with the ring constructed so as to be biased in a radially outward direction to rest against the actuator ring 76. The locking dogs also rest on the upper edge of the annular ring 72. Mounted around the lower end of the housing 45 is a generally cylindrical shaped latching housing 79. The upper portion 79*a* of the latching housing 79 is slidably mounted about the outside of the housing 45. An annular groove 79*b* is provided near the upper end of the housing 79. An inner portion of the housing 79 is threaded at 79*c* to the outer portion of the actuator ring 76 so that the housing 79 and the actuator ring 76 move as a unit.

Figure 11:
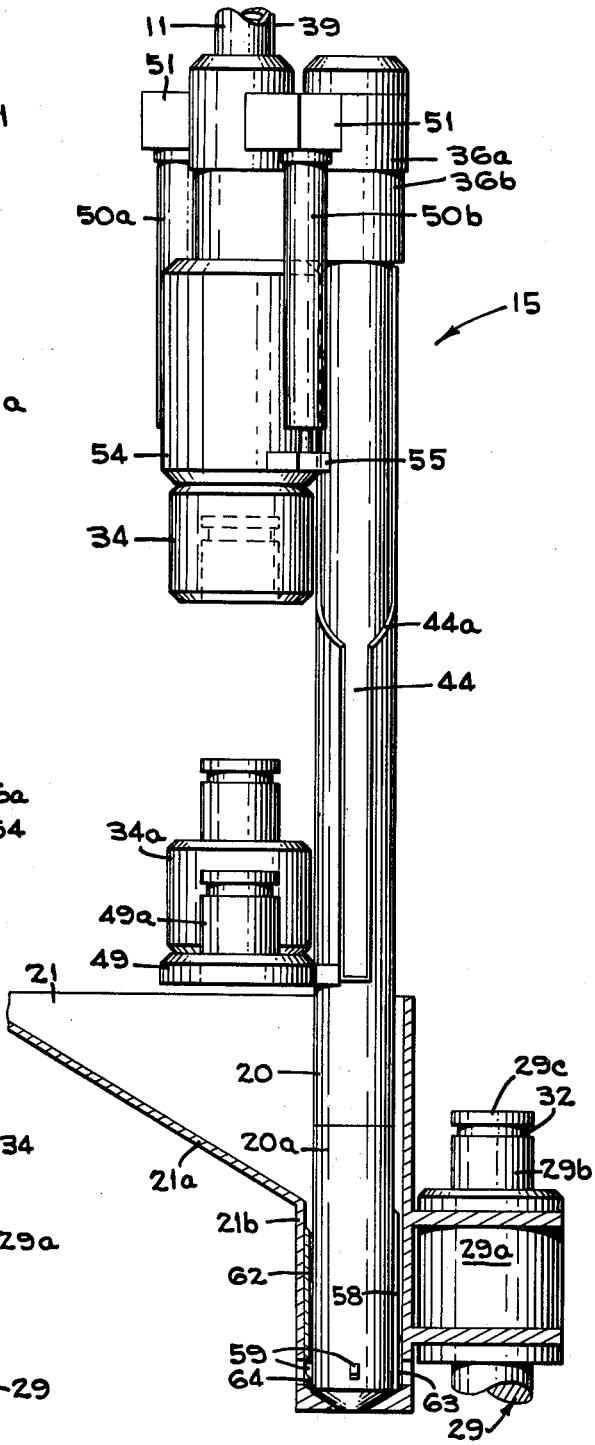

When the tree cap 34 (FIG. 23) is to be positioned on the upper end 29*b* (FIG. 11) of the subsea tree 29, the latching housing 79 and the actuating ring 76 (FIG. 23) are moved upward relative to the cylindrical housing 45 until the actuator ring 76 contacts the lower side of the lower flange 47. When the actuator ring 76 is moved upward away from the locking dogs 77 these dogs move outward against the guides 71 so that the tree cap 34 may be lowered onto the upper end 29*b* of the subsea tree 29 (FIG. 11). With the tree cap in position on the subsea tree, the latching housing 79 and the actuator ring 76 are moved downward into the position shown in FIG. 23 so that the actuator ring 76 forces the locking dogs inwardly into the groove 32 formed in the end 29*b* (FIG. 11), thereby locking the tree cap securely onto the upper end of the subsea tree 29.

Figure 24:
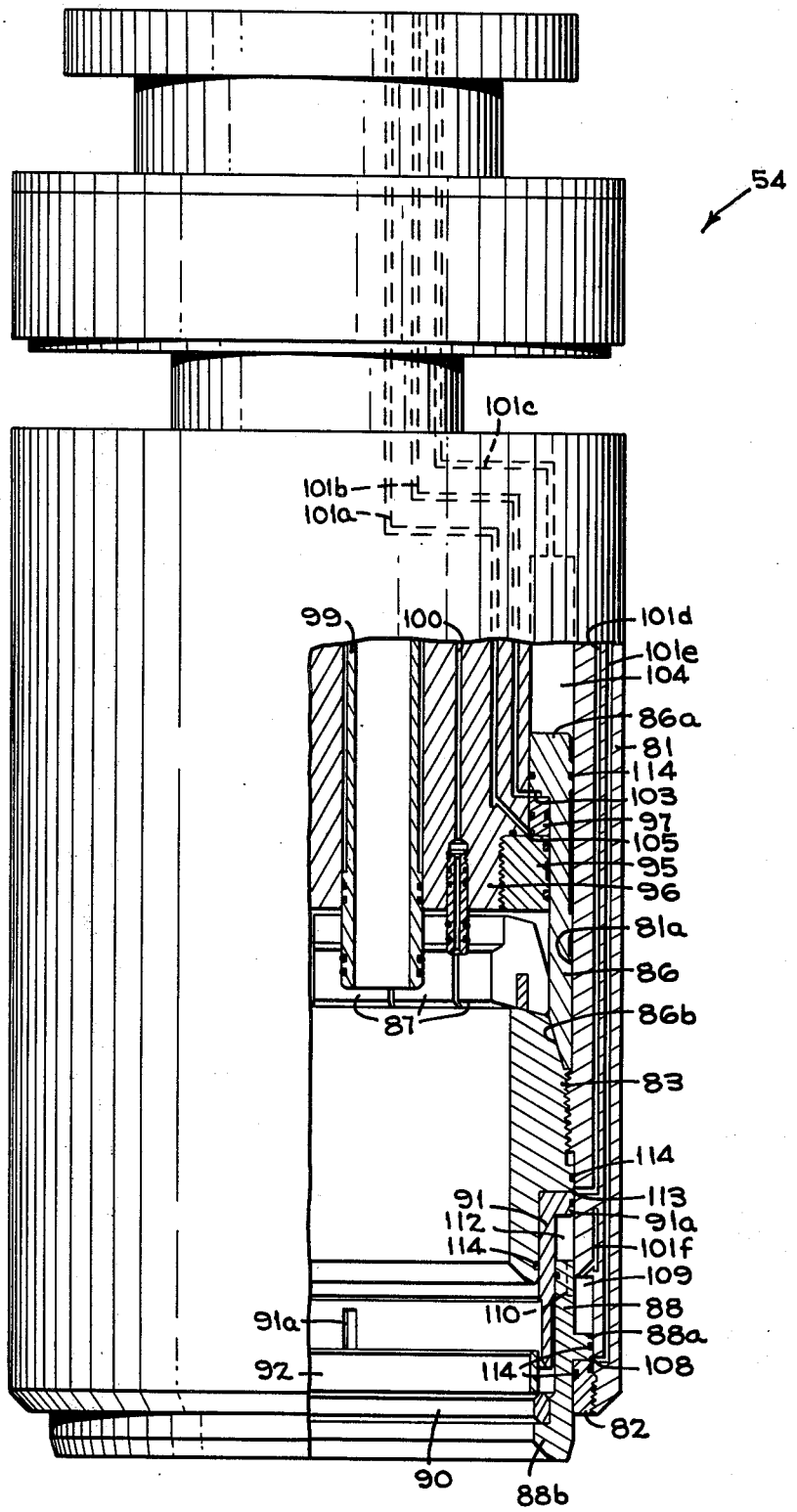
FIG. 24 is an enlarged side elevation with portions being broken away, of the running tool.

The running tool 54 includes a cylindrical housing 81 (FIG. 24) having an annular ring 82 threaded to the inside of the housing at the lower end thereof, and an annular adjustment ring 83 which is threaded to the lower inner surface of the cylindrical housing. An annular actuating piston 86 having an inwardly extending flange 86*a* at the upper end is slidably mounted inside the housing 81. The lower end of the actuating piston 86 includes a wedge-shaped cam surface 86*b*. A plurality of locking dogs 87 are constructed of a flexible ring which is biased in a radially outward direction to press against the lower portion of the actuating piston 86. The locking dogs 84 rest on the upper edge of the adjustment ring 83. An annular housing latching piston 88, having an outwardly extending flange 88*a* and an inwardly extending flange 88*b*, is slidably mounted inside the lower portion of the housing 81. Mounted inside the lower portion of the latching piston 88 is a split ring 90 which is biased in a radially outward direction against the latching piston 88. The split ring 90 rests against the upper edge of the flange 88*b* inside the lower end of the latching piston 88. An annular split ring-engaging piston 91 having a flange 91*a* on the upper end thereof is slidably mounted between the latching piston 88 and the lower portion of the adjustment ring 83. An annular retaining ring 92, which is connected to the latching piston 88 through slots 91*a* in the engaging piston 91, aids in retaining the split ring 90 in position adjacent the flange 88*b* of the piston 88. A ring 95 is threaded to an internal portion 96 of the housing 81. A secondary unlatching piston 97 is slidably mounted between the internal portion 96 of the housing and the actuating piston 86. A pipe 99 and a hydraulic line 100, which are mounted in the internal portion 96 of the housing, extend into the portion of the running tool where they may be connected to a pipe and a hydraulic line inside the subsea tree 29 of FIG. 1.

Power to move the various pistons (FIG. 24) is supplied through a plurality of hydraulic lines 101*a*-101*f*. Power to raise the actuating piston 86 is provided by fluid which flows from the hydraulic line 101*b* into a chamber 103, thereby forcing fluid against the lower edge of the flange 86*a* and causing the piston 86 to move upward. Fluid supplied to a chamber 104 by a hydraulic line 101*c* provides a pressure to force the piston 86 in a downward direction. The actuating piston 86 may also be moved upward to release the locking dogs 87 by applying fluid under pressure to a chamber 105, thereby forcing the secondary unlatching piston 97 to move upward and to press against the flange 86*a* so that the piston 86 moves upward. This secondary unlatching piston is normally actuated only in the event that leakage of fluid or other failure in the hydraulic line 101*b* prevents the pressure in the chamber 103 from increasing enough to move the piston 86 to an unlatched position.

Power to raise the housing latching piston 88 (FIG. 24) is provided by hydraulic fluid which flows from the hydraulic line 101*e* into a chamber 108. The fluid in the chamber 108 provides an upward force against the flange 88*a* causing the piston 88 to move upward. The upper end of the piston 88 engages the flange 91*a* of the ring engaging piston 91 thereby moving the split ring engaging piston 91 into the position shown in FIG. 24. Power to lower the latching piston 88 is provided by hydraulic fluid which flows from the hydraulic line 101*f* into chamber 109. The fluid in the chamber 109 provides a downward force on the upper surface of the flange 88*a*, thereby moving the piston 88 downwardly into position shown in FIG. 24. Fluid also flows from the chamber 109 through a slot 110 in the piston 88 into a chamber 112 where the fluid provides an upward force on the flange 91*a* to move the ring engaging piston 91 to the position shown in FIG. 24. Fluid from the hydraulic line 101*d* flows into a chamber 113, thereby providing a pressure which forces the ring engaging piston 91 in a downward direction. A plurality of seals 114 prevent hydraulic fluid from leaking from the chambers.

Operation

The sequence of operations used to pick up a tree cap 34 with the running tool 54, to place the tree cap on the upper end of a subsea tree 29, to lock the tree cap in position, and to remove the running tool from the tree cap will now be described in connection with the drawings of FIGS. 8, 11, 23 and 24. The sequence will start with the tree cap and the running tool elements in the positions shown in FIGS. 23 and 24.

In order to fit the running tool around the tree cap, the annular actuating piston 86 (FIG. 24) of the running tool 54 is moved to the upper end of the chamber 104 by applying hydraulic fluid to the chamber 103. This allows the locking dogs 87 to move against the inside surface 81*a* of the wall of the housing 81 so that the running tool 54 can be lowered on to the tree cap 34 (FIGS. 8, 23) with the locking dogs 87 positioned adjacent the groove 46*a* (FIG. 23) and the split ring 90 adjacent the groove 79*b* of the tree cap. This position can be accurately determined because the locking dogs 87 will be adjacent the groove 46*a* when the ring 95 (FIG. 24) rests against the upper edge of the flange 46 (FIG. 23) of the tree cap. The adjustment ring 83 (FIG. 24) may be rotated to change the positions of the locking dogs 87 relative to the ring 95 and insure that the locking dogs are adjacent the groove 46*a*. This adjustment is made prior to fastening the running tool to the tree cap and lowering them to the seafloor.

When running tool 54 is in position around the tree cap 34 hydraulic power is applied to the chamber 104 (FIG. 24), forcing the actuating piston downward and forcing the locking dogs 87 inwardly into the groove 46*a* (FIG. 23) of the tree cap 34, thereby locking the running tool securely to the tree cap housing. Hydraulic fluid is next applied to the chamber 113, causing the split ring energizing piston 91 to move downward and force the split ring 90 (FIG. 24) into the groove 79*b* (FIG. 23), thereby locking the split ring 90 (FIG. 24) and the latching piston 88 to the latching housing 79 of the tree cap.

The latching piston 88 and the split ring 90 are then moved upward causing the actuating ring 76 to move upward, by applying fluid to the chamber 108, so that the locking dogs 77 of the tree cap (FIG. 23) move radially outward against the guides 71. When the locking dogs 77 are against the guides 71 the tree cap can be moved onto the upper end 29*b* of the subsea tree 29 (FIG. 11) with the lower edge of the flange 47 of the tree cap (FIG. 23) resting on the upper edge of the flange 29*c* of the subsea tree (FIG. 11) and the locking dogs 77 adjacent the groove 32 of the subsea tree. The latching piston 88 of the running tool (FIG. 24) is then moved downward which forces the latching housing 79 of the tree cap (FIG. 23) and the actuator ring 76 down, thereby forcing the locking dogs 77 (FIG. 23) into the groove 32 (FIG. 11) and locking the tree cap 34 in place on the subsea tree 29.

The running tool can be released from the tree cap by moving the piston 91 (FIG. 24) upward to release the split ring from the groove 79*b* (FIG. 23), and by moving the piston 86 (FIG. 22) upward to release the locking dogs 87 from the groove 46*a* (FIG. 23).

In addition to locating and locking onto the wellhead, the present invention can be used to inspect the wellhead, remove a tree cap, replace a tree cap, remove a control pod, replace a control pod and undertake and complete downhole wireline operations with a single trip of the riser from the surface of the sea to the seafloor and return. For example, a tree cap can be removed, a new tree cap installed, and downhole work done, all in one trip to the seafloor. It is also possible to install guidelines, run TV, install flowlines and other tasks on this same trip. The steps of a tree cap replacement operation can be seen by observing the reentry sequence shown in FIGS. 1–16.

The component manipulator device 15 is first completely tested and serviced aboard the vessel 12 and a new tree cap 34*a* (FIGS. 3 and 4) is locked onto the storage depot 49*b*. The surface vessel 12 (FIG. 1) is moved to within a few hundred feet of the wellhead 17 using the navigation system located on the vessel. The riser 11 and the component manipulator device 15 are lowered until the manipulator device is an area approximately 20 feet above the top of the tree cap 34. The TV/sonar tool is run through the bore of the riser 11 until the tool 16 protrudes from the bottom of the running tool 54 to a point flush with the lower tip 20*a* of the reentry probe 20. The TV/sonar tool is used for guidance while the tip 20*a* of the reentry probe is maneuvered to within six feet of the funnel 21 and directly above the mouth of the funnel. The riser 11 is rotated until the manipulator device 15 is within about 22.5 degrees of being aligned within its desired position relative to the funnel, i.e. with the probe guide key 58 (FIG. 5) being aligned with the slot 63 (FIG. 6) in the neck portion 21*b* of the funnel. It is possible to align the probe 20 with the funnel 21 prior to inserting the probe into the funnel so that rotation of the riser is not necessary.

Figure 8:
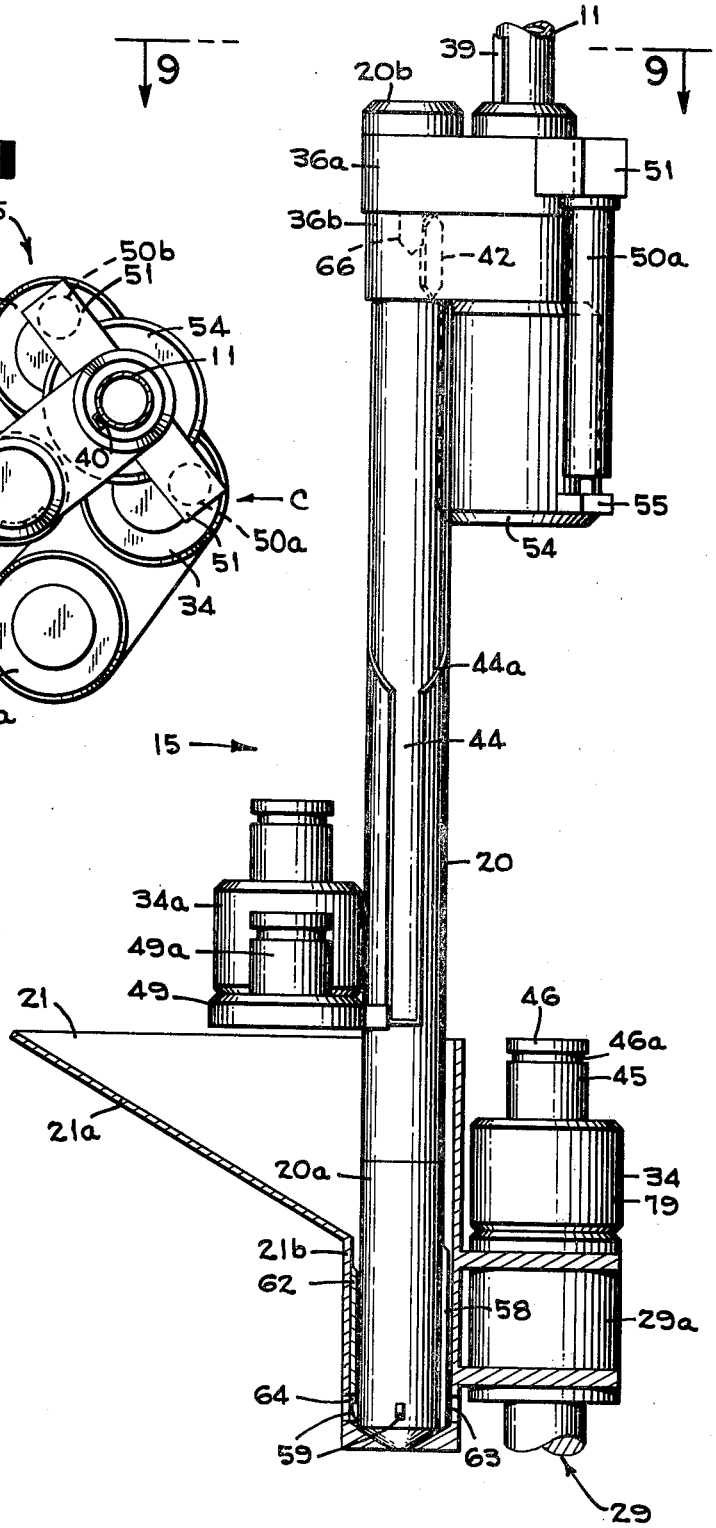
FIG. 8 is a side elevation, similar to FIG. 5, showing the probe locked into position in the funnel.

The hydraulic lowering rams 50*a*, 50*b* are slowly powered down to lower the probe 20 into the funnel 21 (FIG. 5) so that the tip 20*a* of the probe slides along the inclined portion 21*a* and into the neck portion 21*b* of the funnel (FIG. 8). The probe guide key 58 (FIG. 5) and the orienting cam 62 in the funnel (FIG. 6) cooperate to rotate the probe 20 and the riser 11 into the position shown in FIG. 8 as stated hereinbefore. The probe latches 59, on the tip 20*a*, lock into the detents 64 (FIG. 6) in the lower neck portion of the funnel. If mud or debris in the reentry funnel 21 should prevent proper entry of the probe into the funnel a stream of high pressure water can be directed through the riser 11 or through the probe 20 to clear such obstructions, and the probe is then moved into the funnel. The bottom end of the neck portion of the funnel 21 is open to facilitate cleaning such debris from the funnel.

Once the reentry probe 20 has been locked into place in the neck of the reentry funnel 21, a riser tensioning system (not shown) on the surface vessel 12 applies upward tension to the riser to assure safe operation and prevent collapse of the riser due to extreme bending of the riser. Such bending may be caused by movement of the water against the riser. Approximately 40,000 pounds of upward tension is required for safe operation in 1000 feet of water so it is rather easy to detect if the reentry probe has been locked into the reentry funnel by activating the riser tensioning system and then measuring the upward tension to the riser. The TV/sonar reentry tool is used to inspect the tree cap area and/or the area about the control pods if these are to be replaced. The TV/sonar tool 16 is then retracted into the riser 11 so that the running tool 54 can be used to remove the old tree cap and install a new one or the running tool can be used to replace the control pod.

Figure 10:
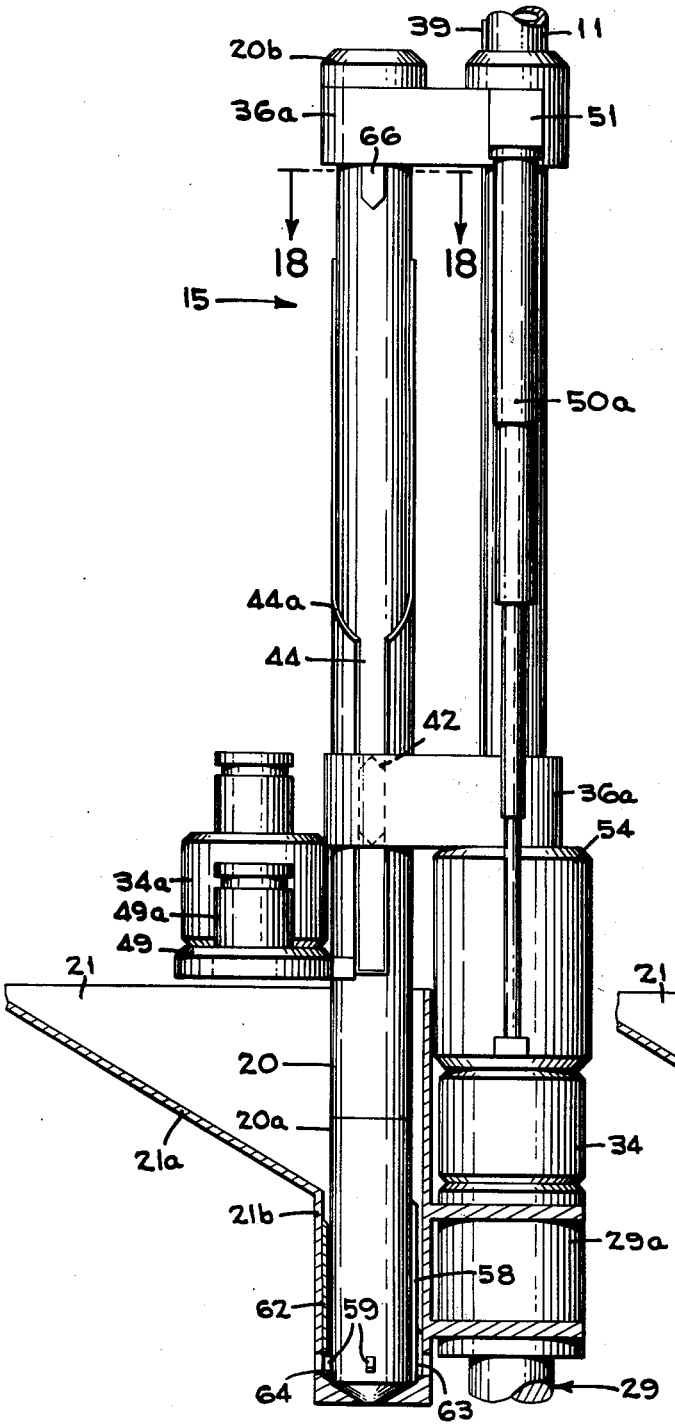
FIGS. 10–13 are side elevations, similar to FIG. 8, showing a sequence of operation of the apparatus.

In order to replace the tree cap the running tool 54 is pulled down into the position shown in FIG. 10 by the lowering rams 50*a*, 50*b* and lowered over the tree cap 34 with the inwardly projecting lug 42 riding in the groove 44 (FIGS. 10 and 19). The old tree cap is removed and the lowering rams 50*a*, 50*b* are then collapsed so that the lug 42 moves to the upper end of the groove 44*a* on the probe 20. The upper end of the riser 11 is rotated clockwise so that the lug 42 moves into the groove 68 (FIG. 19), thereby positioning the old tree cap 34 and the running tool 54 over the storage depot 49*a* (FIGS. 11 and 14). The lowering rams 50*a*, 50*b* are extended so that the old cap 34 is forced down onto the storage depot 49*a* (FIG. 12), the running tool 54 releases the old cap, and the running tool is then moved upward to the position shown in FIG. 13.

Figure 16:
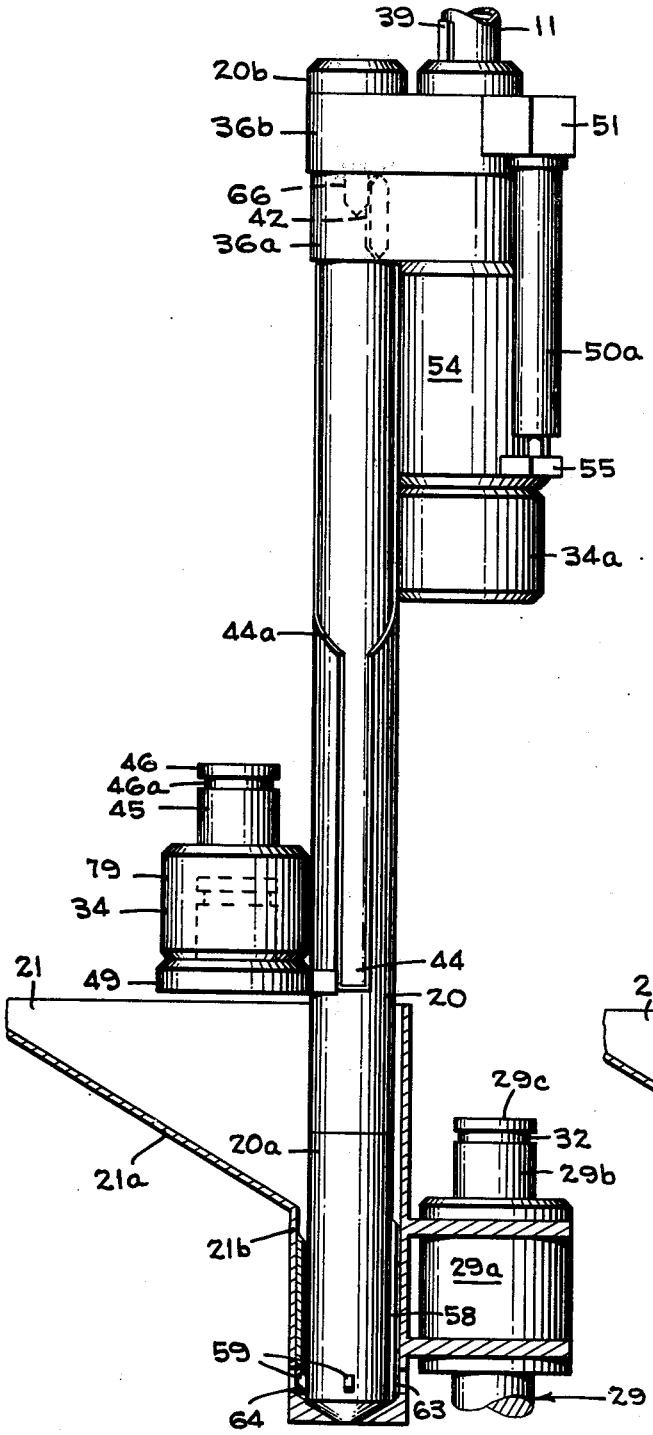

If downhole work is required the running tool is positioned over the upper portion 29*a* of the subsea tree 29 and then locked and sealed to the subsea tree, following which any downhole wireline tasks are completed. After the completion of the downhole work the lowering rams are again collapsed so that the lug 42 moves to the upper end of the groove 44*a*. The riser 11 is rotated counterclockwise so that the inwardly projecting lug 42 moves into the groove 67 (FIG. 19) with the running tool directly above the new tree cap 34*a* on the storage depot 49*b* (FIG. 14). The running tool 54 is lowered onto the new cap 34*a* (FIG. 13) and the cap 34*a* is lifted off the storage depot 49*b*. The riser is rotated clockwise until the inwardly projecting lug 42 (on the lower guide sleeve 36*b*) moves into the center groove 44 on the reentry probe 20. The new tree cap 34*a* is lowered into position and locked onto the upper portion 29*a* of the subsea tree (FIG. 16). The TV/sonar tool 16 can again be extended from the lower end of the running tool 54 and the new tree cap installation inspected. If the tree cap is properly installed the probe latches 59 (FIG. 3) are released by hydraulic lines (not shown) which are connected between the tip 20*a* of the reentry probe and the surface vessel 12. The reentry probe 20, the riser 11, and the component manipulator 15 can be moved upward (FIG. 17) and returned into the surface vessel. It should be noted that the subject invention can be employed with a drill pipe or even with a flexible cable as well as a riser.

When it is desirable to replace both a tree cap and a control pod in a single trip to the seafloor, a second embodiment 20' of the reentry probe is used. This reentry probe includes five separate grooves (FIG. 22) for guiding the inwardly projecting lug 42 of the lower guide sleeve 36*b* so that the running tool 54 may be positioned at any of five different locations about the reentry probe 20' (FIG. 20). For example, the new tree cap may be stored on the storage depot 49*a* (FIG. 20) and a new control pod stored on the storage depot 49*b*. To reach the storage depot 49*a* (FIG. 20) the projecting lug 42 is moved into the groove 68*b* (FIG. 22); to reach the storage depot 49*b* the lug 40 is moved into the groove 67*b*; to reach the control pod 35*a* the lug is moved into the groove 68*a*; to reach the control pod 35*b* the lug 40 is in the groove 67*a* and to reach the old tree cap 34 the lug is moved into the groove 44.

In order to change the tree cap, to change a control pod, and do downhole work in a single trip of the riser down from the surface, the following sequence may be used. Let us assume that the tree cap 34 and the control pod 35*b* are faulty. With a new tree cap on depot 49*a*, and a new pod on depot 49*b*, and the probe 20' locked into the funnel 21, the new control pod is moved from the depot 49*b* (FIG. 20) and stored on top of the good control pod on the tree. For example, the new pod is moved from the depot 49*b* and stored on top of the good pod 35*a*. The top portion of each of the control pods is shaped so that the bottom portion of another control pod can be forced down and locked upon it. The old tree cap 34 is moved onto the storage depot 49*b* and the running tool moved over the top of the tree so that the downhole work can be completed. When the downhole work is completed, the new tree cap is moved from the storage depot 49*a* onto the top of the subsea tree, the defective control pod 35*b* is removed from the tree and stored on the depot 49*b*. The new control pod is removed from its temporary storage position on top of the pod 35*a* and installed at the location where the pod 35*b* was removed. This is all done in one trip to the seafloor.

The present invention can also be used with subsea trees which are mounted below the mudline. It is also possible to reverse the positions of the probe 20 and the funnel 21 so that the probe is mounted on the subsea installation and the funnel is mounted on the lower end of the tubular column.

It is possible to use the probe 20 and the manipulator device 15 with a cable instead of a riser. A hydraulic motor can be connected between the probe 20 and the manipulator device 15 to rotate the manipulator about the probe. The probe 20, the cylinders 50*a*, 50*b*, the running tool 54, the guide sleeves 36*a*, 36*b* and other elements shown in FIG. 5 can be connected to the lower end of a cable which is suspended from the surface vessel 12 (FIG. 1). Hydraulic lines can be connected from the surface vessel to the hydraulic cylinders 50*a*, 50*b* and to the hydraulic motor (not shown). The probe can be lowered into the offset funnel 21 and the operation of the manipulator device 15 can be controlled in the manner described hereinbefore, the only difference being the use of the hydraulic motor to move the running tool in an arc about the probe 20.

Figure 25:
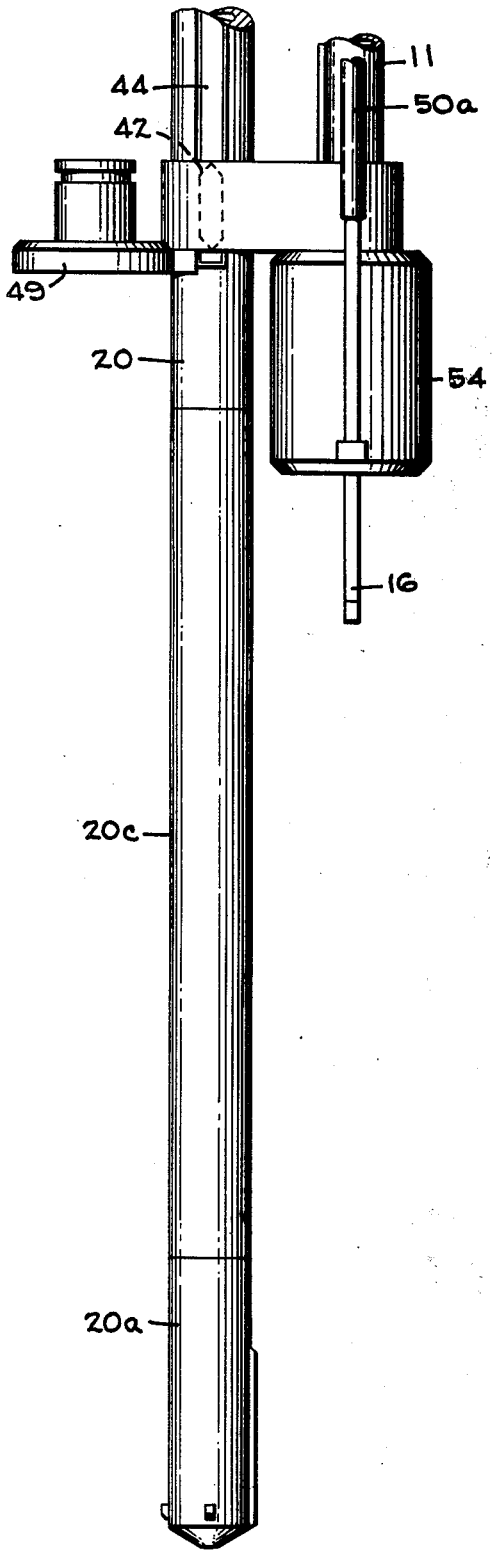
FIG. 25 is a frequently side elevation of a second embodiment of the locking probe.
Figure 26:
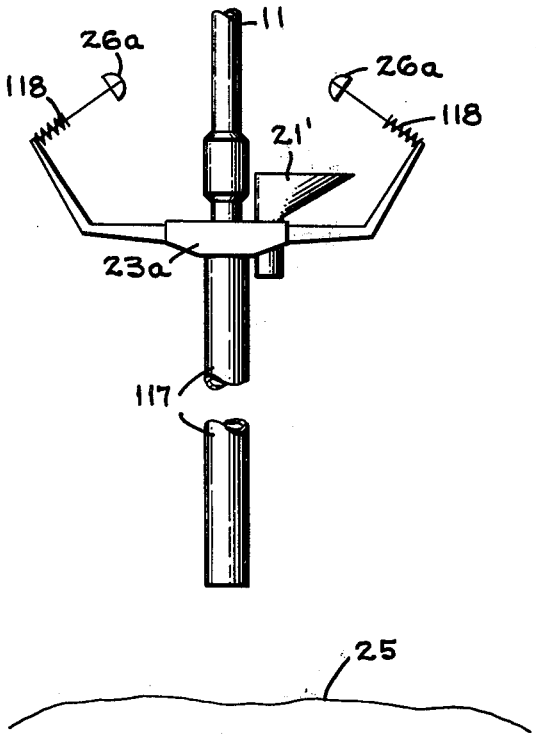
FIGS. 26–37 disclose a sequence of operation of a subsea wellhead system using the present invention for both entry and reentry of subsea well.

Another embodiment of a completely guidelineless wellhead entry and reentry system is disclosed in FIGS. 25–37. The reentry probe 20 of FIGS. 1–22 has been modified into a considerably longer length by the inclusion of an extension 20*c* (FIG. 25) between the probe 20 and the tip 20*a*. This extension allows the probe to reach below the top of the wellhead to the seafloor. A second funnel 21' (FIGS. 26–37) is mounted on a guidebase 23*a* to facilitate initial entry into the wellhead without the guidelines commonly employed prior to the installation of a subsea tree or a blowout preventer. The various steps of installing, using and servicing such a guidelineless wellhead system are shown sequentially in the FIGS. 26–37.

Figure 27:
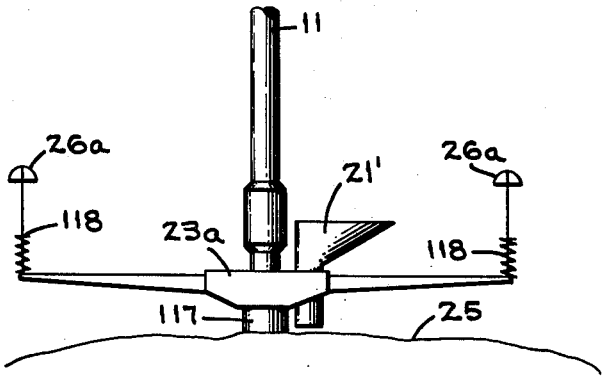
Figure 28:
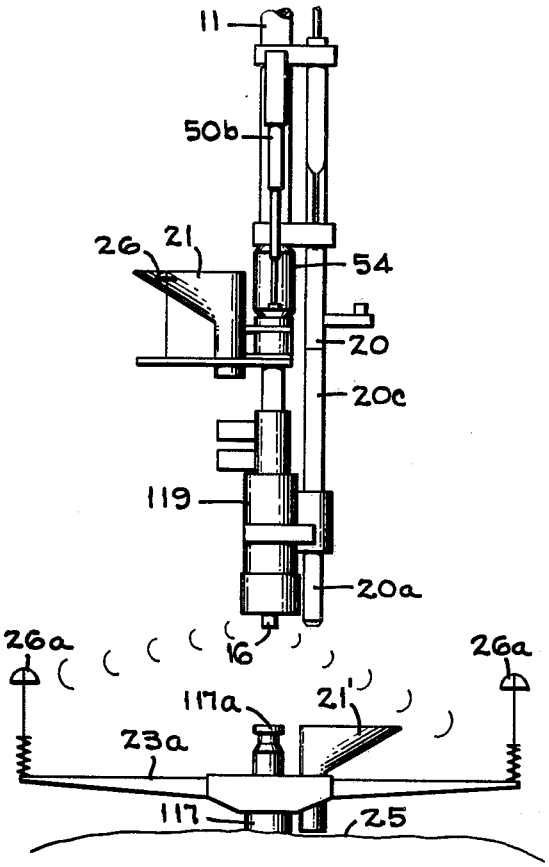

The guidebase 23a (FIG. 26) and a foundation casing 117 are attached to the drill riser 11 for landing on the seafloor 25. The TV/sonar reflectors 26a which are biased toward a vertical position by a plurality of springs 118 are folded inward toward the riser 11 during the time the guidebase is lowered through the moon pool or opening (not shown) in the bottom of the surface vessel 12 (FIG. 1). The foundation casing 117 is driven, or drilled into the seafloor 25 until the guidebase 23a is positioned on the seafloor 25 as shown in FIG. 27. The casing and guidebase are cemented in place in the usual manner, and the reflectors 26a are moved into a vertical position about the guidebase. The drilling riser 11 is disconnected from the guidebase 23a and the riser is returned to the surface vessel 12.

Figure 29:
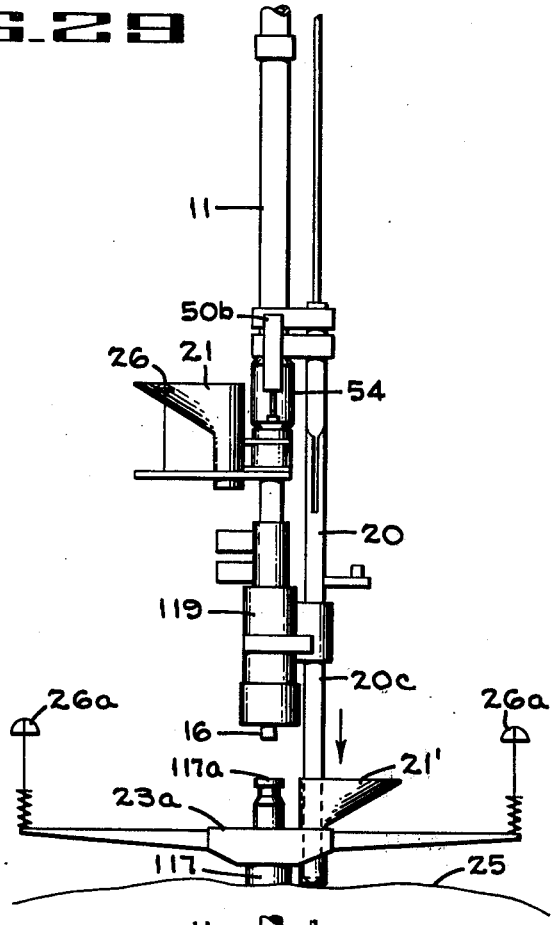
Figure 30:
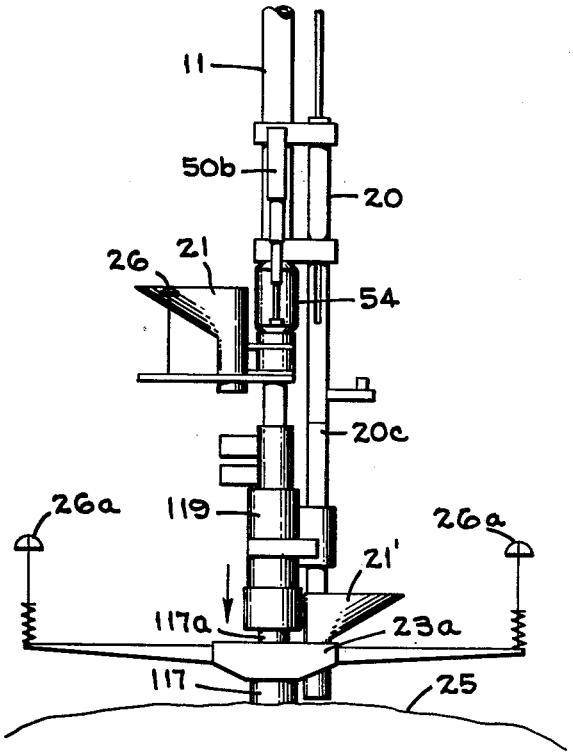
Figure 31:
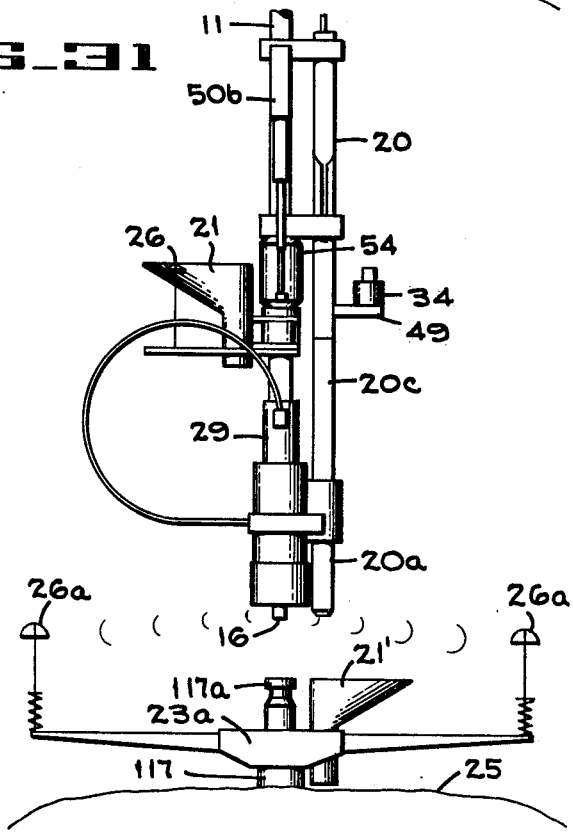
Figure 32:
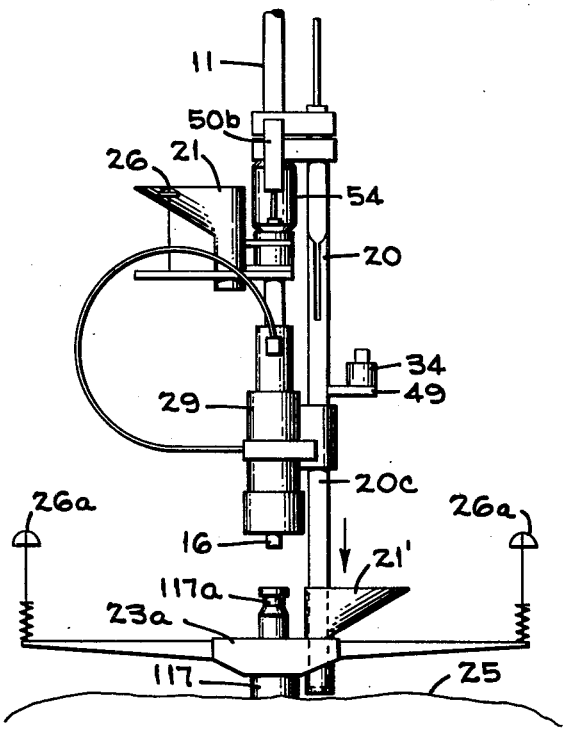
Figure 33:
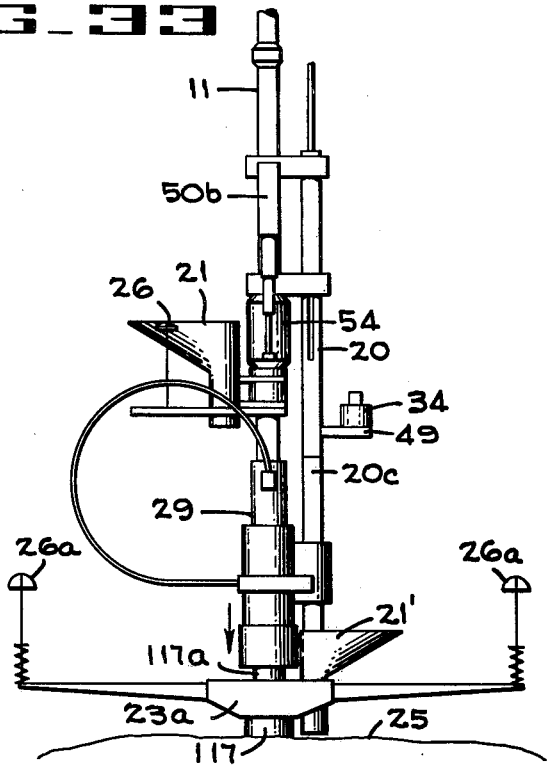

The component manipulator device 15, the long probe 20c a blowout preventer 119 and the reentry funnel 21 are connected to the lower end of the drilling riser 11 (FIG. 28) and returned to a position a few feet above the entry funnel 21' using the TV/sonar tool 16 to direct the operation. The hydraulic lowering rams 50a, 50b are collapsed so that the probe 20a is lowered and locked into position inside the guidebase funnel 21' (FIG. 29). The blowout preventer 119 is then lowered into position (FIG. 30) and locked onto the guidebase 23a so that the drilling operation may be completed and the blowout preventer raised to the surface vessel 12 where the preventer is disconnected from the riser 11.

Figure 34:
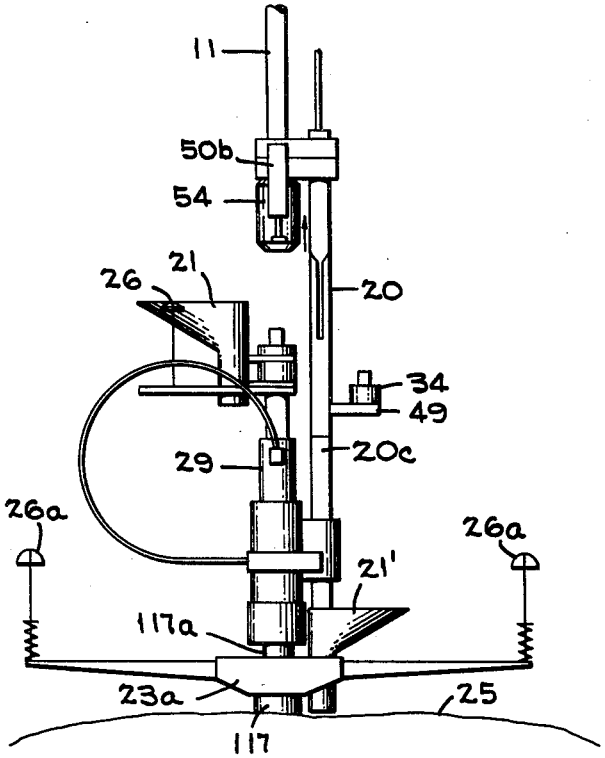
Figure 35:
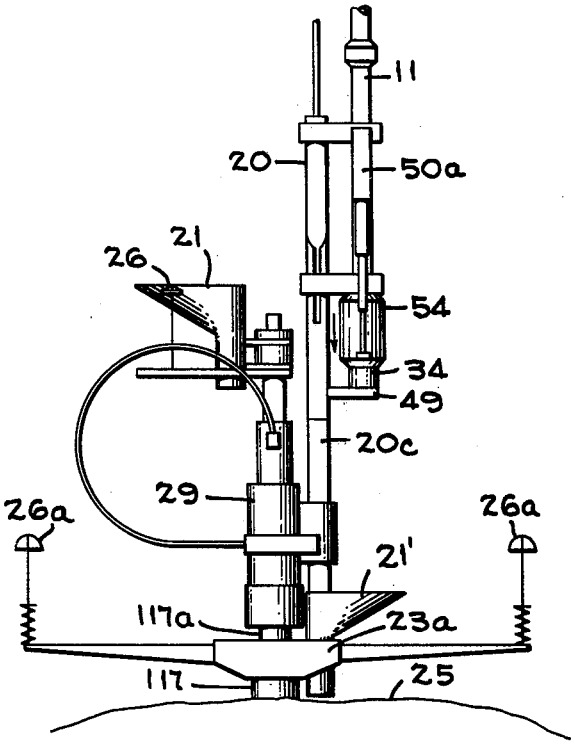
Figure 36:
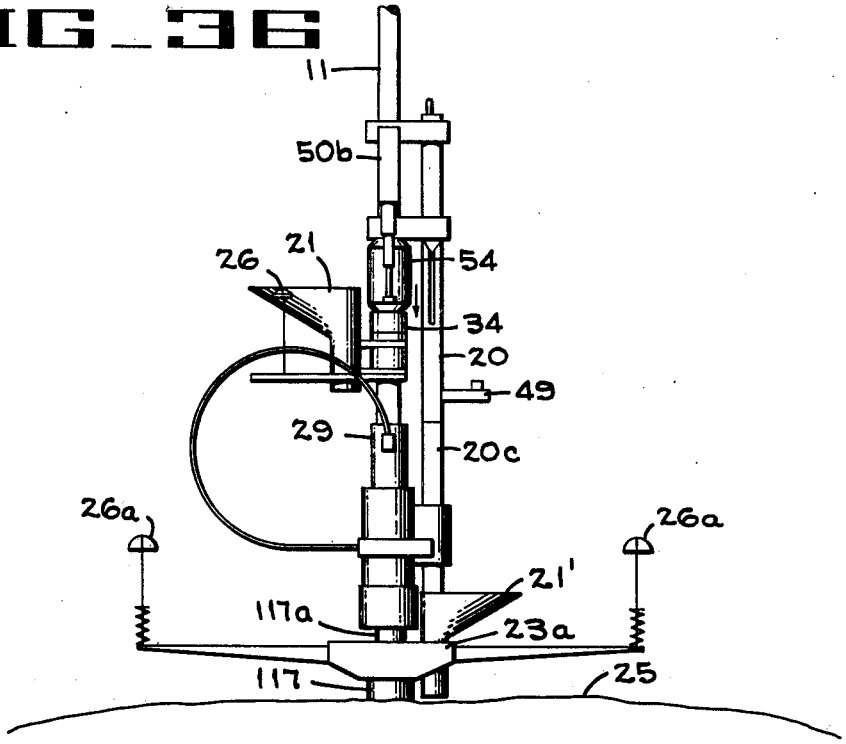
Figure 37:
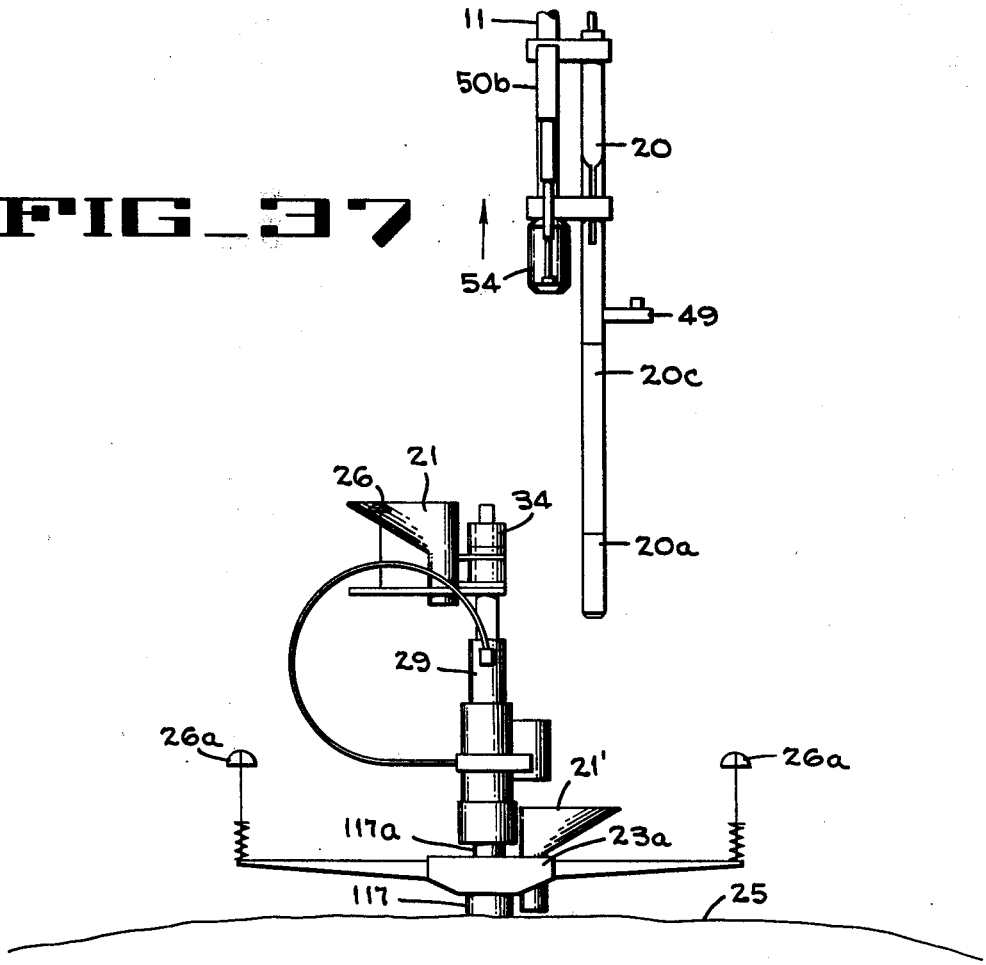

The subsea tree 29 is connected to the riser 11 and lowered to a position (FIG. 31) above the guidebase using the TV/sonar tool 16 extending from the lower end of the subsea tree as a means for guiding the tree into position. The probe 20c is again lowered into the base funnel 21' (FIG. 32) using the lowering rams 50a, 50b. The subsea tree is then guided into position, locked onto the upper end 117a of the casing 117 (FIG. 33), and the running tool 54 then disconnected from the upper end of the subsea tree 29 (FIG. 34). The running tool 54 moves to a storage depot (FIG. 35) to retrieve the cap 34 which is placed on the upper end of the subsea tree 29 as seen in FIG. 36 to complete the installations of the subsea tree 29. The probe 20c is then released (FIG. 37) from the base funnel 21' and the riser 11 and component manipulator device 15 are returned to the surface vessel 12. This reentry system can be used to reenter any subsea equipment such as pipe line manifolds, submarines, etc. and is not restricted to the reentry of wellheads.

The present invention provides a simple means for entering or reentering a subsea wellhead without the use of guidelines between the wellhead and a surface vessel. TV/sonar equipment is used to direct the operating and service equipment into a position adjacent the wellhead. An offset funnel mounted on the wellhead and a probe mounted on a component manipulator device are used to accurately guide the manipulator device into working alignment with the various parts on the wellhead. Replacement parts are stored on depots on the manipulator device so that defective parts can be replaced and downhole work done on a well in a single trip to the seafloor. The present invention eliminates the problem of guideline cables being broken or dropped onto the seafloor especially when wells have been abandoned for a time and then reentry is desired.

Although the best mode contemplated for carrying out the present invention has been herein shown and described, it will be apparent that modification and variation may be made without departing from what is regarded to be the subject matter of the invention.

What is claimed is:

1. A guidelineless subsea wellhead entry system for use with an elongated column and a subsea well having a subsea installation attached thereto, said system comprising:

an elongated probe;

means for connecting said probe to said column;

an offset funnel having a wide mouth portion and a smaller neck portion, the axis of said neck portion being parallel to and spaced from the axis of said mouth portion of said funnel;

means for mounting said funnel to said subsea installation;

means for locating said subsea installation; and means for moving said probe and said column toward said funnel.

2. A guidelineless subsea wellhead entry system as defined in claim 1 including means for securing said probe in position after said probe is moved into said neck portion of said funnel.

3. A guidelineless subsea wellhead entry system as defined in claim 1 including a manipulator device, means for connecting said manipulator device to said elongated column, means for positioning said manipulator device in a predetermined number of rotational positions about said probe.

4. A guidelineless subsea wellhead entry system for use with a tubular column and a subsea well having a subsea installation attached thereto, said system comprising:

a locking probe;

means for connecting said probe to said tubular column;

an offset funnel having a wide mouth portion and a smaller neck portion, the axis of said neck portion being parallel to, and spaced from the axis of said mouth portion of said funnel, said mouth portion having a sloping contour to facilitate movement of said probe over said mouth portion toward said neck portion, said neck portion having means for securing said probe in position after said probe is moved into said neck portion;

means for mounting said offset funnel to said subsea installation with the axis of said neck portion parallel to and spaced from the axis of said subsea well;

means for locating said subsea installation;

a component manipulator device; and means for connecting said locating means and said manipulator device to said tubular column.

5. A guidelineless subsea wellhead entry system as defined in claim 4 wherein said manipulator device includes storage depots for holding replacement parts and a running tool for removing and installing said replacement parts.

6. A guidelineless subsea wellhead entry system as defined in claim 4 wherein said means for mounting said offset funnel includes means for mounting the axis of said neck portion between the axis of said subsea well and the axis of said mouth portion of said funnel.

7. A guidelineless subsea wellhead entry system as defined in claim 4 including means for mounting said locking probe with the axis of said probe parallel to and spaced from the axis of said tubular column.

8. A guidelineless subsea wellhead entry system as defined in claim 4 wherein said subsea installation locating means includes signal sending/receiving means.

9. A guidelineless subsea wellhead entry system as defined in claim 8 including signal reflecting means and means for mounting said signal reflecting means adjacent said wellhead.

10. A guidelineless subsea wellhead entry system as defined in claim 4 including means for selectively latching said probe to said funnel.

11. A guidelineless subsea wellhead entry system as defined in claim 10 including latching means for selectively latching said probe to said funnel and remote control means for operating said latching means.

12. A guidelineless subsea wellhead entry system as defined in claim 4 wherein said means for connecting said probe to said tubular column includes means for raising and lowering said probe relative to the lower end of said tubular column.

13. A guidelineless subsea wellhead entry system as defined in claim 12 wherein said means for raising and lowering said probe includes hydraulic power means and means for remote control of said hydraulic power means.

14. A guidelineless subsea wellhead entry system as defined in claim 4 wherein the axis of said neck portion is adjacent an outer edge of said mouth portion.

15. A guidelineless subsea wellhead entry system as defined in claim 14 including means for mounting said manipulator device with the axis parallel to the axis of said subsea well and with one of said rotational positions coaxial with the axis of said subsea well.

16. A guidelineless subsea wellhead entry system as defined in claim 4 including guide means connected between said probe and said manipulator device for positioning said manipulator device relative to said probe.

17. A guidelineless subsea wellhead entry system as defined in claim 16 wherein said guide means includes rotational stop means for positioning said manipulator device in predetermined rotational positions about said probe.

18. A guidelineless subsea wellhead entry system as defined in claim 16 wherein said guide means includes orientation means for rotational positioning of said probe relative to said funnel and orienting means for rotational positioning of said manipulator device relative to said probe.

19. A guidelineless subsea wellhead reentry system for use with a riser and a wellhead having a subsea tree attached thereto, said system comprising:

a locking probe;

a funnel having a wide mouth portion and a smaller neck portion, said funnel being offset, with the axis of said neck portion parallel to, but spaced from the axis of said mouth portion;

means for connecting said funnel to said subsea tree;

means for connecting said probe to said riser;

means for selectively locking said probe in said neck portion of said funnel when said probe is properly positioned in said neck portion;

a component manipulator device for connecting and disconnecting components from said subsea tree;

signal sending and receiving means;

means for connecting said manipulator device and said signal means to said riser; and signal reflecting means mounted on said subsea tree.

20. A guidelineless subsea wellhead entry system as defined in claim 19 including means for mounting said funnel with the axis of said neck portion parallel to and spaced from the axis of said subsea tree.

21. A guidelineless subsea wellhead reentry system as defined in claim 19 including means for positioning said manipulator device relative to said probe.

22. A guidelineless subsea wellhead reentry system as defined in claim 21 wherein said means for positioning said manipulator device includes means for raising and lowering said manipulator device relative to said probe and means for accurate rotational positioning of said manipulator device about said probe.

* * * * *